US012557842B2

(12) United States Patent
Canfield

(10) Patent No.: US 12,557,842 B2
(45) Date of Patent: Feb. 24, 2026

(54) MOUTHPIECE ASSEMBLY AND VAPORIZER APPARATUS EQUIPPED WITH MOUTHPIECE ASSEMBLY

(71) Applicant: YTTRIUM LLC, Lakewood Ranch, FL (US)

(72) Inventor: Parker Canfield, Lakewood Ranch, FL (US)

(73) Assignee: YTTRIUM LLC, Lakewood Ranch, FL (US)

( * ) Notice: Subject to any disclaimer, the term of this patent is extended or adjusted under 35 U.S.C. 154(b) by 0 days.

(21) Appl. No.: 19/318,612

(22) Filed: Sep. 4, 2025

(65) Prior Publication Data

US 2026/0000113 A1 Jan. 1, 2026

Related U.S. Application Data

(63) Continuation-in-part of application No. 19/052,566, filed on Feb. 13, 2025.

(Continued)

(51) Int. Cl.
*A24F 40/40* (2020.01)
*A24F 7/02* (2006.01)

(Continued)

(52) U.S. Cl.
CPC ..... *A24F 40/40* (2020.01); *A24F 7/02* (2013.01); *A24F 40/10* (2020.01); *A24F 40/485* (2020.01); *A24F 40/49* (2020.01); *A24F 40/60* (2020.01)

(58) Field of Classification Search
None
See application file for complete search history.

(56) References Cited

U.S. PATENT DOCUMENTS 12,043,469 B1 * 7/2024 Graybill ..... A45F 3/18
2007/0045288 A1 * 3/2007 Nelson ..... A61M 11/041 219/533

(Continued)

FOREIGN PATENT DOCUMENTS

CN 106723383 A * 5/2017 ..... A24F 47/008
GB 108592 A * 8/1917 ..... A24F 1/00

(Continued)

OTHER PUBLICATIONS

CN_106723383 with Machine Translation (Year: 2017).*

(Continued)

*Primary Examiner* — Manley L Cummins, IV
(74) *Attorney, Agent, or Firm* — DP IP GROUP; Franco S. De Liguori

(57) ABSTRACT

A mouthpiece assembly for a vaporizer apparatus comprises an external case having an interior space, a mouthpiece aperture at an upper end, and an intake aperture that allows vapor to pass into the interior space and towards the mouthpiece aperture. A sliding module is movably mounted within the interior space of the external case and is configured for sliding movement between an upper position closing the mouthpiece aperture and a lower position opening the mouthpiece aperture. The sliding module includes an interlocking portion configured to engage with corresponding engagement portions in the interior space of the external case to selectively lock the sliding module in the upper position or the lower position.

21 Claims, 25 Drawing Sheets

Related U.S. Application Data

(60) Provisional application No. 63/684,563, filed on Aug. 19, 2024, provisional application No. 63/643,854, filed on May 7, 2024.

(51) Int. Cl.

| | |
|---|---|
| ***A24F 40/10*** | (2020.01) |
| ***A24F 40/485*** | (2020.01) |
| ***A24F 40/49*** | (2020.01) |
| ***A24F 40/60*** | (2020.01) |

(56) References Cited

U.S. PATENT DOCUMENTS

| | | | | |
|---|---|---|---|---|
| 2013/0167854 | A1* | 7/2013 | Shin | A24F 40/42 131/329 |
| 2015/0272211 | A1* | 10/2015 | Chung | A24F 40/40 206/242 |
| 2017/0099877 | A1* | 4/2017 | Worm | A24F 40/40 |
| 2020/0046024 | A1* | 2/2020 | Chen | A24F 40/40 |
| 2020/0390160 | A1* | 12/2020 | Chen | A24F 9/16 |
| 2021/0368867 | A1* | 12/2021 | Qiu | A24F 7/00 |
| 2023/0046508 | A1* | 2/2023 | Lee | A24F 15/01 |
| 2023/0116576 | A1* | 4/2023 | Austin | A24F 40/30 131/330 |
| 2023/0270160 | A1* | 8/2023 | Wiedemann | A24F 1/14 131/330 |
| 2024/0074513 | A1* | 3/2024 | Aller | A24F 40/50 |
| 2024/0316291 | A1* | 9/2024 | Hunter | A61M 15/0085 |
| 2025/0151798 | A1* | 5/2025 | Wang | A24F 40/60 |

FOREIGN PATENT DOCUMENTS

| | | | | | |
|---|---|---|---|---|---|
| KR | 20210117266 | A | * | 9/2021 | A61M 15/06 |
| KR | 20220096556 | A | * | 7/2022 | A24F 40/10 |
| KR | 20240164182 | A | * | 11/2024 | A24F 40/46 |
| KR | 20250096282 | A | * | 6/2025 | C08L 69/00 |
| WO | WO-2023213075 | A1 | * | 11/2023 | A24F 40/40 |

OTHER PUBLICATIONS

KR_20240164182 with Machine Translation (Year: 2024).*
KR_20250096282 with Machine Translation (Year: 2025).*
KR_20210117266 with Machine Translation (Year: 2021).*
KR_20220096556 English Machine Translation (Year: 2022).*
WO_2023213075 English Machine Translation (Year: 2023).*

* cited by examiner 22a
22
24a
24
24b
30
31
33
32
40
45
60
42
80
10

FIG. 43
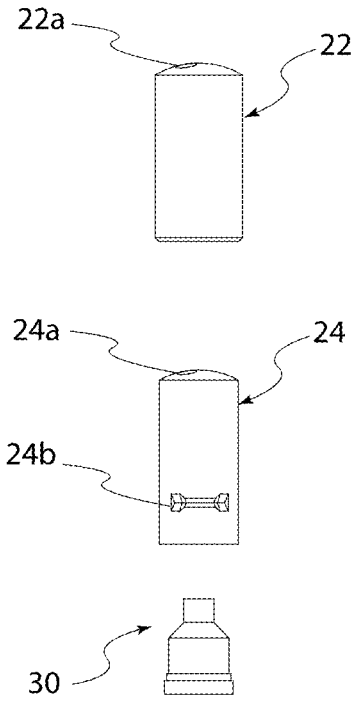
FIG. 44
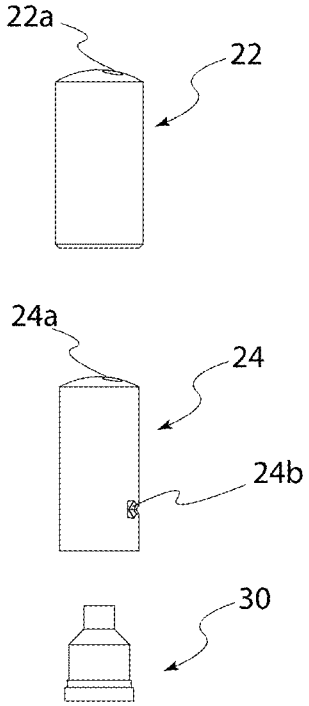
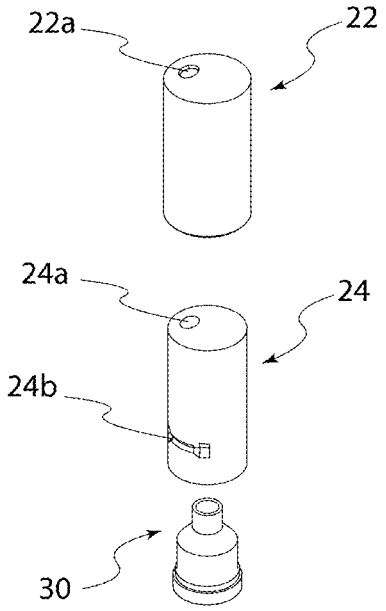
FIG. 45
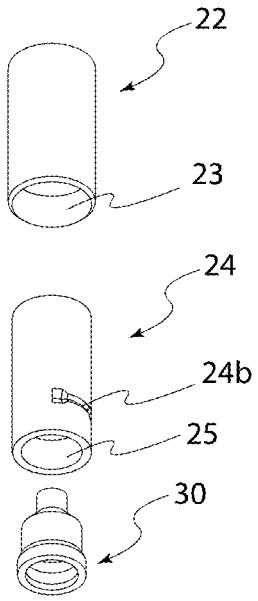
FIG. 46

MOUTHPIECE ASSEMBLY AND VAPORIZER APPARATUS EQUIPPED WITH MOUTHPIECE ASSEMBLY

CROSS-REFERENCE TO RELATED APPLICATIONS

This application is a Continuation-in-Part Patent Application of U.S. patent application Ser. No. 19/052,566, filed Feb. 13, 2025, which claims priority to U.S. Provisional Patent Application No. 63/643,854, filed May 7, 2024, and U.S. Provisional Patent Application No. 63/684,563, filed on Aug. 19, 2024.

BACKGROUND

Technical Field

The present invention relates to vaporizer apparatuses, including vaporizer or vaporization devices and vaporizer systems, for delivering vapor to a user. The present invention also relates to a mouthpiece assembly for the vaporizer apparatus.

Background Information

Vaporizer apparatuses, such as vape pens, are well known in the art. Vape pens are portable, handheld devices used for vaping, which is the act of inhaling and exhaling vapor produced by an electronic cigarette or similar device. Vape pens provide an alternative to burning, allowing for vaporizing of inhalation ingredients often from plant material such as tobacco, various herbs, herbal blends, and cannabis. Vaporizers provide for a healthier experience than burning with exciting and diverse user experiences.

Vape pens typically consist of a few main components, including a tank or cartridge that holds an e-liquid, also known as vape juice or e-juice, a power source (e.g., battery), and an atomizer containing a heating element, usually a coil or atomizer head, which heats up when the battery is activated, to vaporize the e-liquid. The vape pen also includes a mouthpiece which is the part of the vape pen that the user inhales from. The mouthpiece is connected to the atomizer and allows the vapor to be drawn into the user's mouth and lungs.

During use, the user fills the tank or cartridge with e-liquid, which typically contains a mixture of propylene glycol (PG), vegetable glycerin (VG), flavorings, nicotine (optional), and/or cannabis concentrate. When the user presses a button or inhales from the mouthpiece (depending on the type of vape pen), the battery activates and sends power to the atomizer. The atomizer heats up the coil, which then vaporizes the e-liquid. This process creates vapor, which is then inhaled by the user. The user inhales the vapor through the mouthpiece, experiencing the flavor and, if present, the nicotine content of the e-liquid. After inhalation, the user exhales the vapor, which dissipates into the air.

Different vape pens may have variations in design and functionality, but they all operate on the basic principle of heating e-liquid to produce vapor for inhalation. All vape pens also share the common feature of having a mouthpiece. Vape pens can easily collect dust, dirt, and other debris, particularly on the mouthpiece and exposed areas. This can compromise hygiene and affect the vaping experience. Some vape pens may also experience e-liquid leakage, especially when stored or transported without protection. This can lead to messy situations and potential waste of e-liquid. Vape pens are directly exposed to environmental elements such as moisture, heat, or extreme cold, which can affect their performance and lifespan. In addition to failing to provide effective means for e-liquid leak prevention and the preservation of e-liquid quality, existing vape pens also fail to provide effective controls for avoiding odors and ensuring safety and hygiene.

Moreover, child safety is a critical consideration in the design and functionality of vaporizer apparatuses. The design of many vaporizers, particularly those with an always-open mouthpiece, presents significant risks. These devices are often readily accessible once removed from their packaging, making them vulnerable to unintended use by children or others who should not have access to them. This issue is especially concerning for parents who use vaporizers for nicotine or marijuana, as these substances pose serious health risks to children.

One of the primary issues with many vaporizers is that their mouthpieces remain open and accessible at all times. This design flaw means that once the vaporizer is outside its packaging, anyone, including children, can potentially pick up the device and inhale from it. Vaporizers are often small, portable, and can be left in easily accessible places within the home, such as on countertops, tables, or in bags, and are thereby readily accessible to anyone, including children. Without any form of restriction or locking mechanism, there is little to prevent unauthorized or accidental use.

Children are particularly vulnerable to the harmful effects of nicotine and marijuana. Ingesting or inhaling even small amounts of these substances can lead to serious health consequences, including nicotine poisoning or intoxication. The open design of the mouthpiece significantly increases the risk of accidental exposure, which could result in medical emergencies. In this regard, the ease with which a child could accidentally inhale from an open-mouthpiece vaporizer is a significant concern. Children, driven by curiosity, might mimic adult behavior and attempt to use the vaporizer, not understanding the potential dangers. This could lead to unintended inhalation of harmful substances, posing immediate health risks.

In summary, ensuring child safety should be a top priority in the design and distribution of vaporizer apparatuses. The current design of open-mouthpiece vaporizers poses significant risks, particularly to children who may accidentally or unknowingly use these devices.

Accordingly, described herein are vaporizer apparatuses, including vape pens, and a mouthpiece assembly for the vaporizer apparatus which address the foregoing drawbacks with existing vaping devices in the art.

SUMMARY

The present invention relates to a mouthpiece assembly and vaporizer apparatus designed to provide an improved user experience through enhanced functionality, stability, and ease of maintenance. According to one aspect, the invention provides a mouthpiece assembly for a vaporizer apparatus comprising an external case defining an interior space, a mouthpiece aperture at an upper end, and an intake aperture that allows vapor to enter the interior space and pass toward the mouthpiece aperture.

The mouthpiece assembly includes a sliding module movably mounted within the interior space of the external case. The sliding module is configured to move between a closed position, in which a top part of the sliding module closes the mouthpiece aperture, and an open position, in which vapor can flow from the intake aperture through the interior space and out of the mouthpiece aperture. A side-actuated button mounted on the sliding module extends through a slot of the external case to permit user manipulation of the sliding module between the closed and open positions.

The sliding module further includes an interlocking portion, such as a spring-biased element, configured to selectively engage with engagement portions, such as top and bottom divot slots, formed in the interior space of the external case. This arrangement enables the sliding module to be temporarily locked in the closed or open position, providing stability during use and ensuring consistent airflow. The sliding module also includes a first portion extending from a second portion in an inclined manner toward the top part, which promotes efficient vapor flow toward the mouthpiece aperture. Additionally, the sliding module is configured to facilitate cleaning by pushing waste or residue accumulated in the intake aperture upward and out of the mouthpiece aperture when shifted between positions.

The mouthpiece assembly is connected to an atomizer of a vaporizer apparatus via an adapter, which provides an airtight connection between the mouthpiece assembly and the atomizer. The atomizer is configured to receive and vaporize an e-liquid using a heating element energized by a power supply. The adapter may include a metal insert and a gasket to ensure an airtight seal, and can be configured for either threaded engagement or snap-fit engagement with a corresponding portion of the atomizer.

Through this combination of features, the invention provides a vaporizer apparatus that allows vapor to flow efficiently through the mouthpiece, maintains stability and secure locking of the sliding module, facilitates cleaning and maintenance, and ensures an airtight connection between the mouthpiece assembly and the atomizer. The mouthpiece assembly thus enhances the safety, usability, and performance of vaporizer devices.

These and other features and advantages of the present invention will become apparent from the following detailed description of illustrative embodiments thereof, which is to be read in connection with the accompanying drawings.

BRIEF DESCRIPTION OF DRAWINGS

The disclosure will provide details in the following description of preferred embodiments with reference to the following figures wherein:

FIG. 43 is an exploded view showing a general positional relationship between the mouthpiece and interlocking component relative to a gasket for the vape device according to the present invention.

FIG. 44 is a view similar to FIG. 43, but with the mouthpiece, interlocking component and gasket rotated 90 degrees to the right in the figure.

FIG. 45 is a top, perspective exploded view showing a general positional relationship between the mouthpiece and interlocking component relative to the gasket.

FIG. 46 is a bottom, perspective exploded view showing a general positional relationship between the mouthpiece and interlocking component relative to the gasket.

DETAILED DESCRIPTION OF PREFERRED EMBODIMENTS

Figure 1:
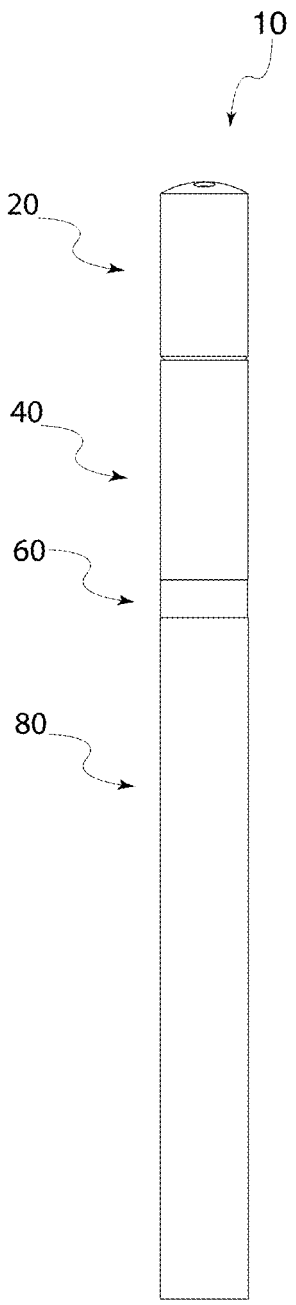
FIG. 1 is a front elevational view of a vaporizer apparatus (hereinafter also "vape device") according to an embodiment of the present invention.
Figure 2:
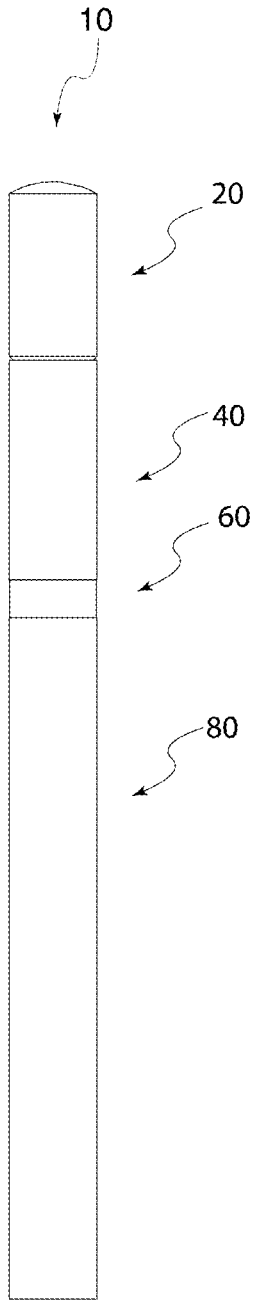
FIG. 2 is a rear elevational view of the vape device shown in FIG. 1.

It is to be understood that both the foregoing general description and the following detailed description are exemplary and explanatory only and are not restrictive of the invention as claimed. The accompanying drawings, which are incorporated in and constitute a part of the specification, illustrate embodiments of the invention and together with the general description, serve to explain the principles of the invention. The figures are intended for representative purposes only and should not be considered limiting in any respect. Throughout the drawings, the same reference numerals denote the same elements.

In one aspect, the present invention is directed to a vaporizer apparatus. In another aspect, the present invention is directed to a mouthpiece assembly for the vaporizer apparatus. Details of the features and advantages of these and other aspects and embodiments of the present invention are described below with reference to the drawings. In FIGS. 1-50, the same reference numerals denote the same elements. In FIGS. 51-77, the same reference numerals denote the same elements.

FIGS. 1-6 show assembled full views of a vaporizer apparatus, generally designated at 10, according to an embodiment of the present invention. In the present embodiment shown in the drawings, vaporizer apparatus 10 (hereinafter also "vape device" or "device") is in the form of a vape pen which is slender and cylindrical, resembling a pen or marker in shape. Vape device 10 is designed to be portable and discreet, making it easy to carry in a pocket or purse. Vape device 10 includes a mouthpiece assembly 20, a cartridge or tank 40, a heating element 60, and a power supply 80.

Figure 47:
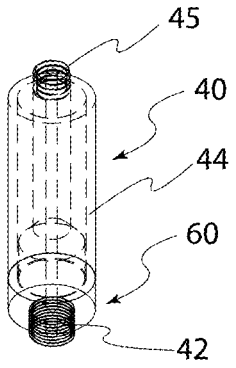
FIG. 47 is a transparent perspective view of a concentrate basin for the vape device according to the present invention.
Figure 48:
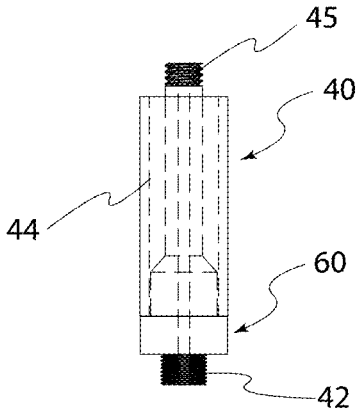
FIG. 48 is a transparent elevational view of the concentrate basin shown in FIG. 47.
Figure 50:
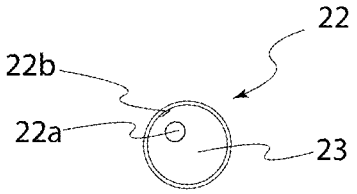
FIG. 50 is a top view of the mouthpiece assembly shown in FIG. 49.
Figure 49:
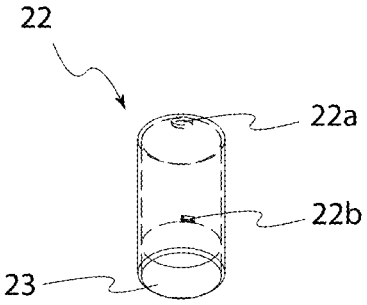
FIG. 49 is a transparent perspective view of the mouthpiece assembly showing a positional relationship between the mouthpiece and interlocking component in a state in which a cam of the interlocking component is engaged with a cam follower of the mouthpiece.
Figure 51:
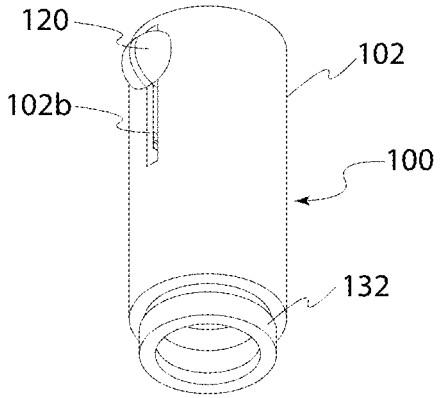
FIG. 51 is a perspective view illustrating an assembly according to another embodiment of the present invention, with the assembly shown to highlight the mouthpiece aperture in a closed state.
Figure 52:
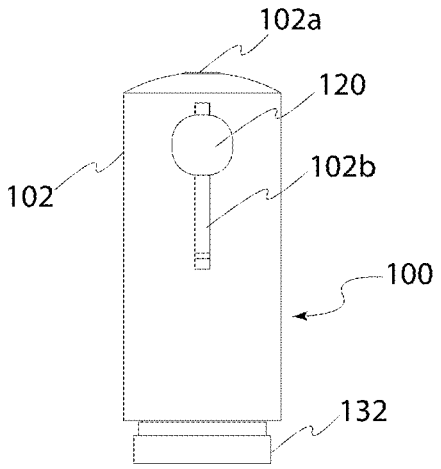
FIG. 52 is a front view of the assembly in FIG. 51.
Figure 53:
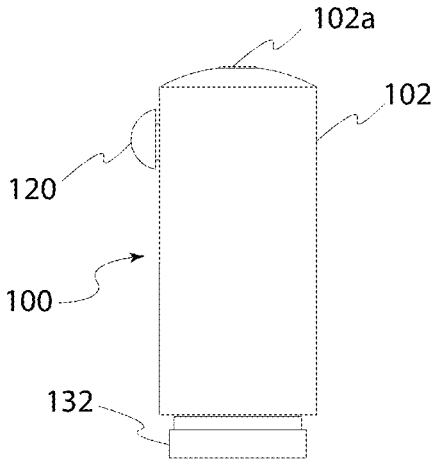
FIG. 53 is a right-side view of the assembly in FIG. 52.
Figure 54:
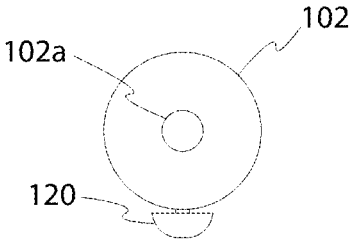
FIG. 54 is a top view of the assembly in FIG. 52.
Figure 55:
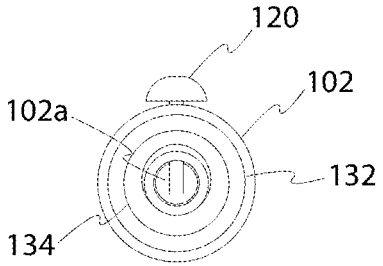
FIG. 55 is a bottom view of the assembly in FIG. 52.
Figure 56:
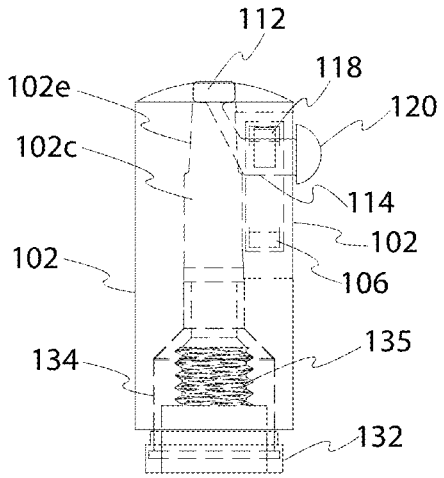
FIG. 56 is a left-side view of the assembly in FIG. 52, the view being presented with certain components shown as transparent in order to better illustrate various internal features of the assembly.
Figure 57:
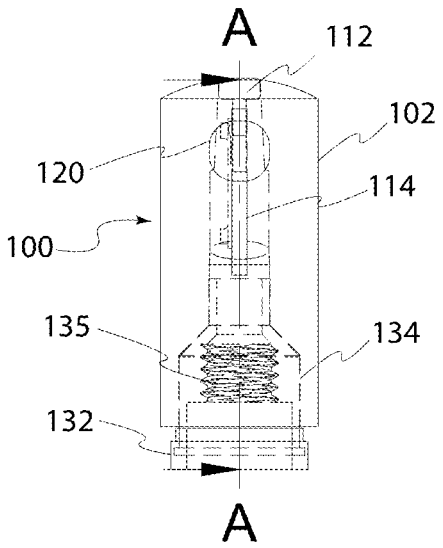
FIG. 57 is a view similar to FIG. 52, except that certain components are shown as transparent in order to better illustrate various internal features of the assembly.
Figure 58:
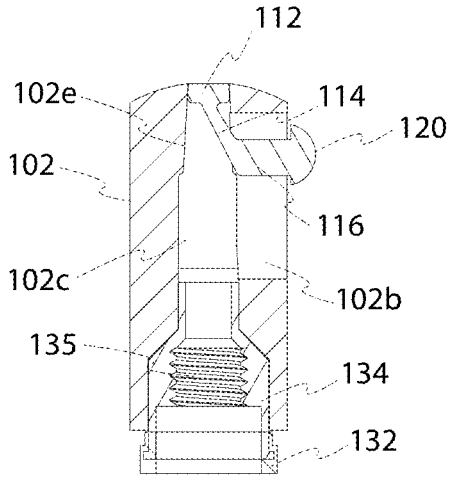
FIG. 58 is a cross-sectional view taken along the line A-A in FIG. 57.
Figure 59:
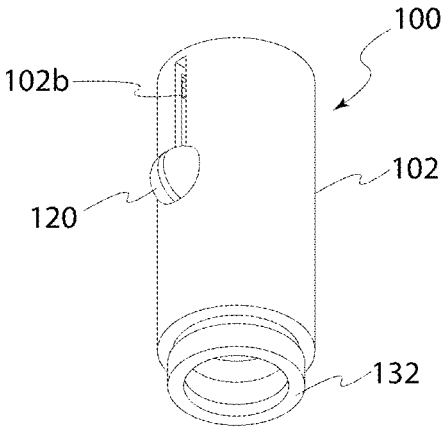
FIG. 59 is a view similar to FIG. 51, except that the assembly is shown to highlight the mouthpiece aperture in an open state.
Figure 60:
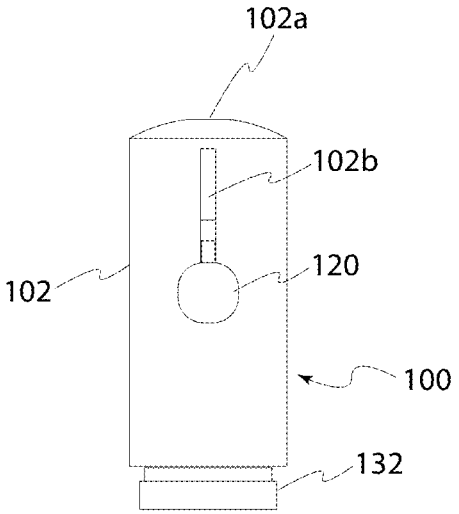
FIG. 60 is a front view of the assembly in FIG. 59.
Figure 61:
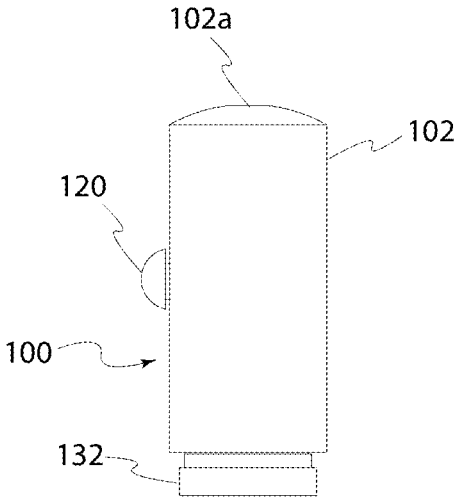
FIG. 61 is a right-side view of the assembly in FIG. 52.
Figure 62:
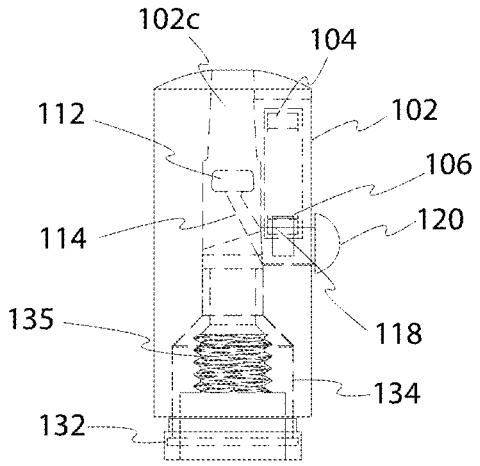
FIG. 62 is a left-side view of the assembly in FIG. 60, the view being presented with certain components shown as transparent in order to better illustrate various internal features of the assembly.
Figure 63:
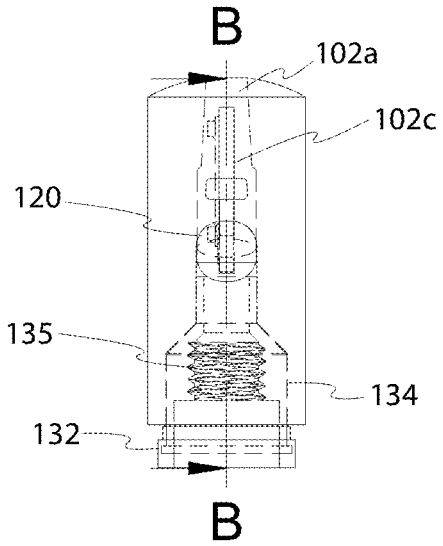
FIG. 63 is a view similar to FIG. 60, except that certain components are shown as transparent in order to better illustrate various internal features of the assembly.
Figure 64:
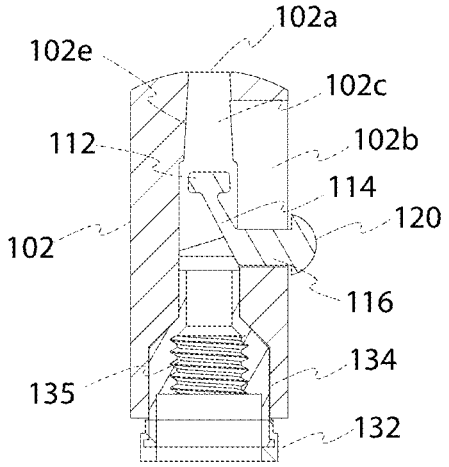
FIG. 64 is a cross-sectional view taken along the line B-B in FIG. 63.
Figure 65:
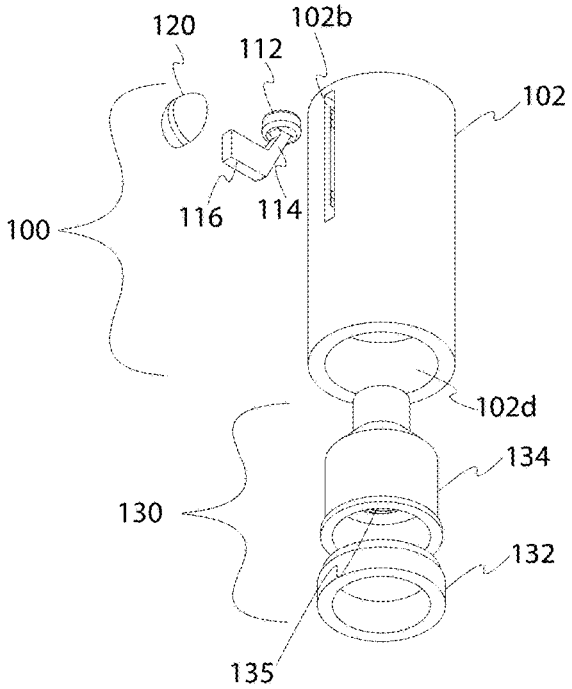
FIG. 65 is an exploded perspective view of the assembly illustrated in FIGS. 51-64.

FIGS. 7-10 show various exploded views of vape device 10 shown in FIGS. 1-6. Mouthpiece assembly 20 is connected to tank 40 via an adapter 30, which in the present embodiment is in the form of a tubular fitting. Tank 40 is also in the form of a tubular member configured to hold an e-liquid, also known as vape juice or e-juice, for device 10. Tank 40 is also configured to receive and hold therein an atomizer 44 containing heating element 60 (e.g., a coil or atomizer head) which heats up when the battery is activated, to vaporize the e-liquid. FIGS. 47-48 are transparent views of tank 40 illustrating the placement therein of atomizer 44 with heating element 60. Tubular fitting 30 is configured to interconnect mouthpiece assembly 20 to tank 40 as shown in the drawings and further describe below.

Figure 3:
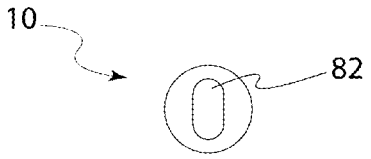
FIG. 3 is a bottom view of the vape device shown in FIG. 1.
Figure 4:
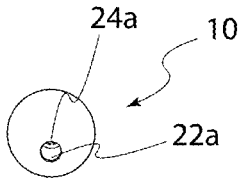
FIG. 4 is a top view of the vape device shown in FIG. 1.
Figure 5:
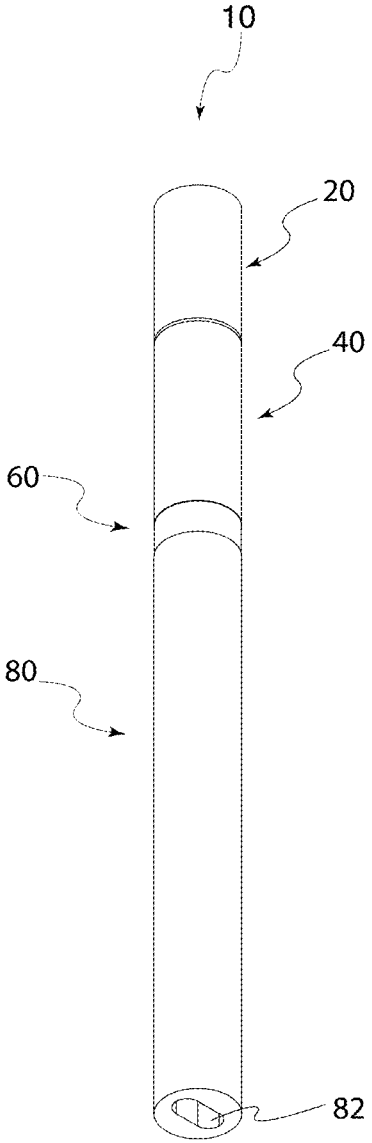
FIG. 5 is a bottom perspective view of the vape pan shown in FIG. 1.
Figure 6:
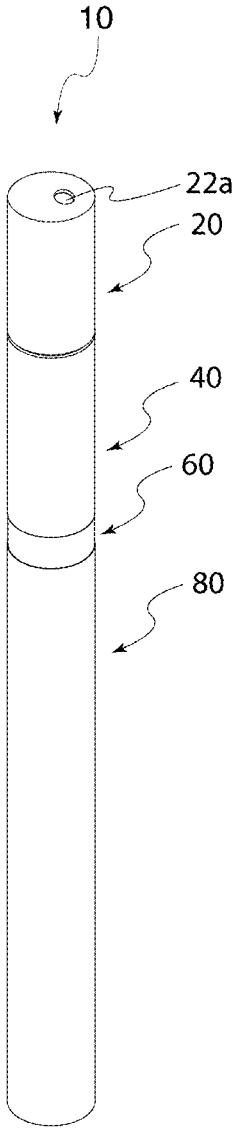
FIG. 6 is a top perspective view of the vape device shown in FIG. 1.
Figures 7, 8:
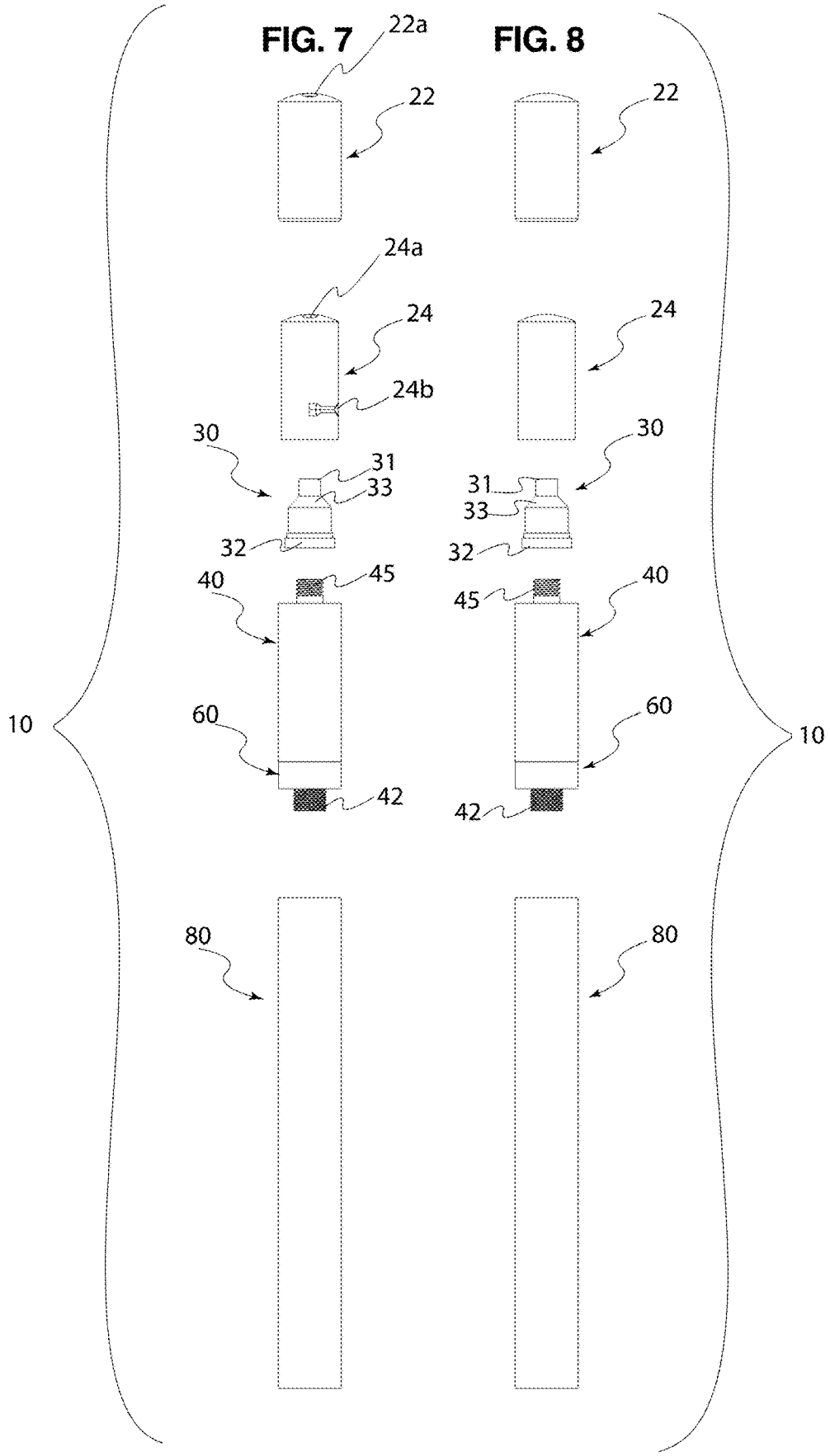
FIG. 7 is an exploded view of the vape device shown in FIG. 1.
FIG. 8 is an exploded view of the vape device shown in FIG. 2.

Power supply 80 may comprise a rechargeable battery, for example, charged via a USB port 82 as shown in FIGS. 3 and 5. The inclusion of a rechargeable battery charged via a USB port offers several advantages. Firstly, it provides convenience and versatility, allowing users to charge their vape devices from various power sources, such as laptop computers, car chargers, or portable battery packs. This flexibility makes it easy to keep the device powered up while on the go. Moreover, USB charging is widely accessible, eliminating the need for specialized charging adapters or cables. This simplifies the charging process and reduces the number of accessories users need to carry. Additionally, USB charging is environmentally friendly, as it reduces the consumption of disposable batteries and minimizes electronic waste. By utilizing rechargeable batteries, vape devices with USB charging contribute to sustainability efforts by promoting reuse and reducing resource consumption. Furthermore, the ability to recharge the battery extends the lifespan of the device, as users can easily replenish power without the need for replacement batteries. This promotes cost-effectiveness and long-term usability, enhancing the overall value proposition of the vape pen. Overall, the integration of a rechargeable battery charged via USB port enhances the user experience by offering convenience, versatility, environmental friendliness, and cost-effectiveness.

Vape device 10 can also be provided with a switch or button (not shown) for turning device 10 on and off. When the switch or button is pressed by the user, power supply 80 activates and sends power to atomizer 44. The switch or button is also pressed by the user to deactivate vape device 10 when it is not in use. This feature helps conserve battery life and prevent accidental activation while the vape pen is being carried or stored. In an alternative embodiment, vape device 10 can be configured so that power supply 80 is activated when the user inhales from mouthpiece assembly 20 without the need for pressing a button or switch.

As shown in the drawings, vape device 10 is provided with a vape flow passage corresponding to a designated pathway for the flow of vapor from atomizer 44 to mouthpiece assembly 20. More specifically, the flow passage begins within tank 40, where the e-liquid is stored. Tank 40 features a refillable reservoir or a disposable cartridge that holds the e-liquid. From tank 40, the e-liquid flows into atomizer 44, which is a component responsible for heating the e-liquid and converting it into vapor. Atomizer 44 contains heating element 60 (e.g., a heating coil or element) which, for example, is wrapped with a wick or surrounded by a porous material (not shown) that absorbs the e-liquid and facilitates its vaporization when heated. Within atomizer 44, heating element 60 serves as the primary heat source. When activated, heating element 60 heats up and vaporizes the e-liquid absorbed by the wick or surrounding material. This process creates the vapor that users inhale. The wick or surrounding material within the atomizer serves to absorb and deliver e-liquid to the heating element and ensures a consistent supply of e-liquid for vaporization and helps regulate the flow of vapor through vape device 10. As vapor is produced within atomizer 44, it travels through the vape flow passage, including designated pathways integrated into atomizer 44, as shown in FIGS. 47-48, or separate channels designed to facilitate the passage of vapor from atomizer 44 to mouthpiece assembly 20. The vapor then reaches mouthpiece assembly 20 from which users inhale, allowing users to draw the vapor produced in atomizer 44 into their mouths and lungs. Overall, the flow passage in vape device 10 ensures the efficient delivery of vapor from tank 40, through atomizer 44 and tubular fitting 30, and to the user via mouthpiece assembly 20, providing a satisfying vaping experience.

Tank 40, including atomizer 44 containing heating element 60, power supply 80, and switch or button as described above generally mirror the standardized components found in currently available vape devices. Below are detailed descriptions of aspects and features of vape device 10 according to the present invention, along with their corresponding advantages, over currently available vape devices.

A feature of vape device 10 as another aspect of the present invention is directed to mouthpiece assembly 20, including the structural configuration and corresponding functions of mouthpiece assembly 20 as well as the structural and positional relationships between mouthpiece assembly 20, tank 40, atomizer 44 with heating element 60, and power supply 80, as further described below.

As shown in FIGS. 1, 2, 5 and 6, mouthpiece assembly 20 is located at the top of vape device 10 and features a comfortable generally cylindrical shape or design for ease of use. As can be further appreciated from FIGS. 1-6, the entire vape device 10, including mouthpiece assembly 20, features a flush, uniform outer surface profile with benefits including sleek aesthetics, comfortable handling, and ease of storage and transportation. Additionally, such a structural configuration of vape device 10 enhances the user experience by providing a more ergonomic and visually appealing device.

Figure 12:
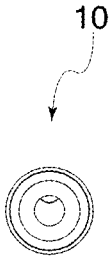
FIG. 12 is a bottom view of the mouthpiece assembly shown in FIG. 11.
Figure 13:
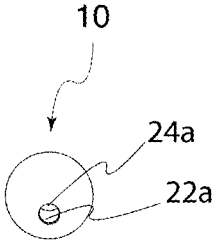
FIG. 13 is a top view of the mouthpiece assembly shown in FIG. 11.
Figure 11:
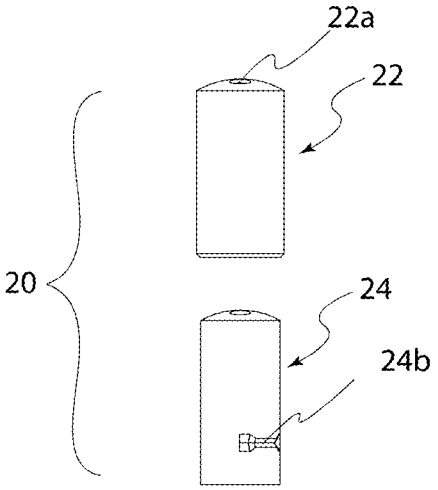
FIG. 11 is an exploded view of a mouthpiece assembly for the vape device according to the present invention.
Figure 14:
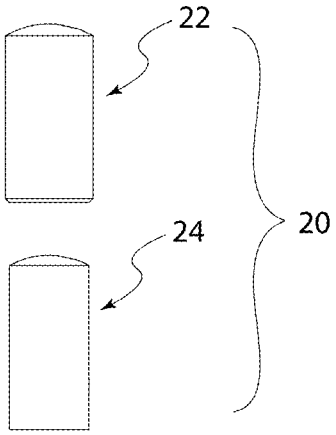
FIG. 14 is another exploded view of the mouthpiece assembly.
Figure 15:
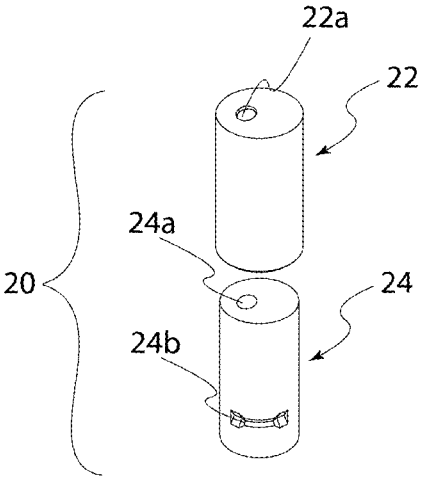
FIG. 15 is a top perspective view of the mouthpiece assembly shown in FIG. 11.
Figure 16:
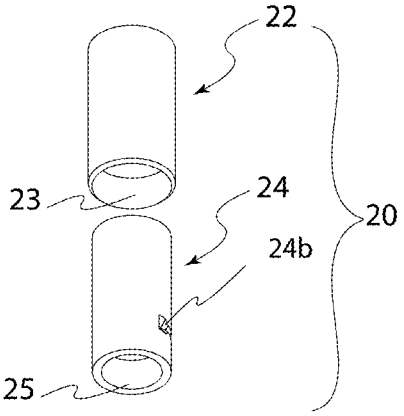
FIG. 16 is a bottom perspective view of the mouthpiece assembly shown in FIG. 12.
Figure 17:
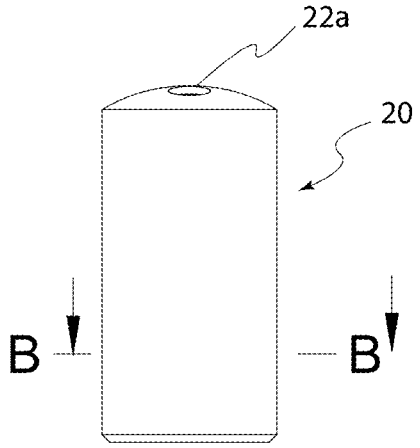
FIG. 17 is an elevational view of the mouthpiece assembly in an assembled state.
Figure 18:
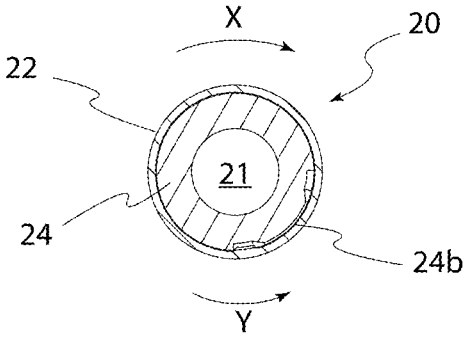
FIG. 18 is a cross-sectional view taken along the line B-B in FIG. 17.
Figure 19:
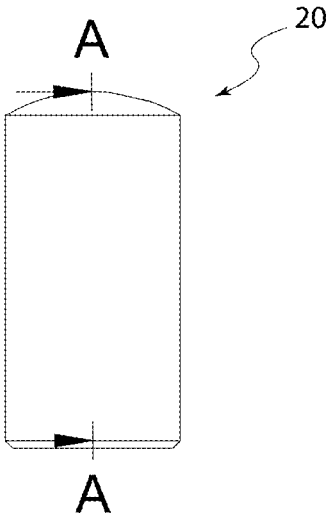
FIG. 19 is another elevational view of the mouthpiece in an assembled state.
Figure 20:
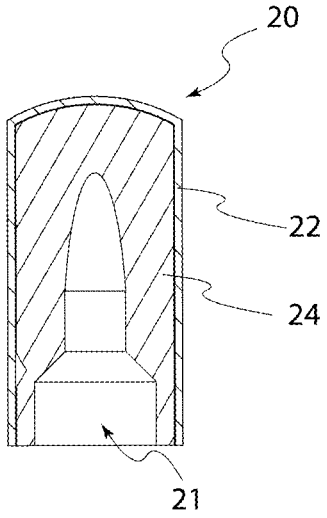
FIG. 20 is a cross-sectional view taken along the line A-A in FIG. 19.
Figure 21:
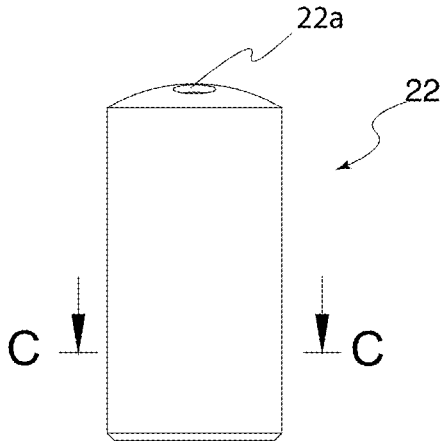
FIG. 21 is an elevational view of a mouthpiece forming part of the mouthpiece assembly according to the present invention.
Figure 22:
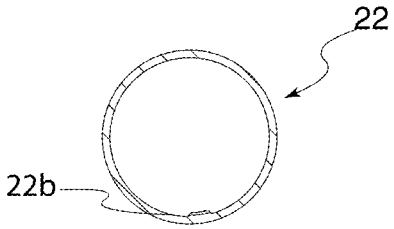
FIG. 22 is a cross-sectional view taken along the line C-C in FIG. 21.
Figure 23:
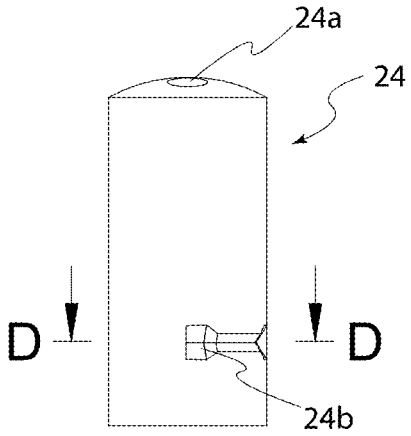
FIG. 23 is an elevational view of an interlocking component forming part of the mouthpiece according to the present invention.
Figure 24:
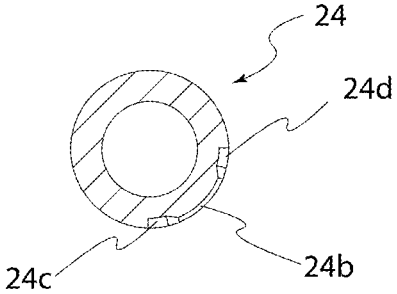
FIG. 24 is a cross-sectional view taken along the line D-D in FIG. 21.

FIGS. 11, 14-16, and 21-24 show various full, exploded and cross-sectional views of mouthpiece assembly 20. FIGS. 12-13 show bottom and top views, respectively, of mouthpiece assembly 20 in FIGS. 11, 14. FIGS. 17-20 are views of mouthpiece assembly 20 in the assembled state. FIGS. 31-36 and 37-42 show various views of the parts forming mouthpiece assembly 20. The construction of mouthpiece assembly 20 according to an embodiment of the present invention is further described below with reference to the figures.

According to a feature of the present invention, mouthpiece assembly 20 is formed of two separate parts including a mouthpiece 22 (second tubular member) and an interlocking component 24 (first tubular member). Each of mouthpiece 22 and interlocking component 24 (hereinafter also referred to as "component") has a tubular shaped configuration. Mouthpiece 22 has a lower open end providing access into an inner space or internal cavity 23 of mouthpiece 22 that is configured and dimensioned to receive therein component 24. In this configuration, mouthpiece 22 is configured to be mounted over and surround an outer surface of component 24, as shown in FIGS. 17-20. Component 24 has a lower open end providing access to an inner space or internal cavity 25 of component 24. Mouthpiece 22 has an upper closed end provided with a hole **22*a* opening into corresponding inner space 23. Similarly, component 24 has an upper closed end provided with a hole 24*a* opening into corresponding inner space 25**.

Referring back to FIGS. 7-10, tubular fitting 30 has a top end portion 31 configured to be inserted into and integrally retained within interior space 25 of component 24. Top end portion 31 includes a seal 33 (e.g., a rubber washer) for preventing leaks during the flow of vapor, acting as a barrier to ensure that the e-liquid remains contained and does not leak out during use of vape device 10. Top end portion 31 of tubular fitting 30 may also be provided with a threaded portion for removable threaded engagement with a corresponding threaded portion in the interior space 25 of component 24. Alternatively, top end portion 31 may be integrally connected to a surface of interior space 25 of component 34 using a suitable adhesive or equivalent connecting means, for example. In this embodiment, a bottom end portion 32 of tubular fitting 30 is configured for removable connection to tank 40 via threaded engagement with a threaded portion 45 of atomizer 44. A lower portion of tank 40 below heating element 60 is provided with a threaded section 42 for threaded engagement with a corresponding threaded section 84 of power source 80. The general positional relationship between mouthpiece 22 and component 24 of mouthpiece assembly 20 relative to tubular fitting 30 is illustrated in the exploded views of FIGS. 43-46.

Figure 9:
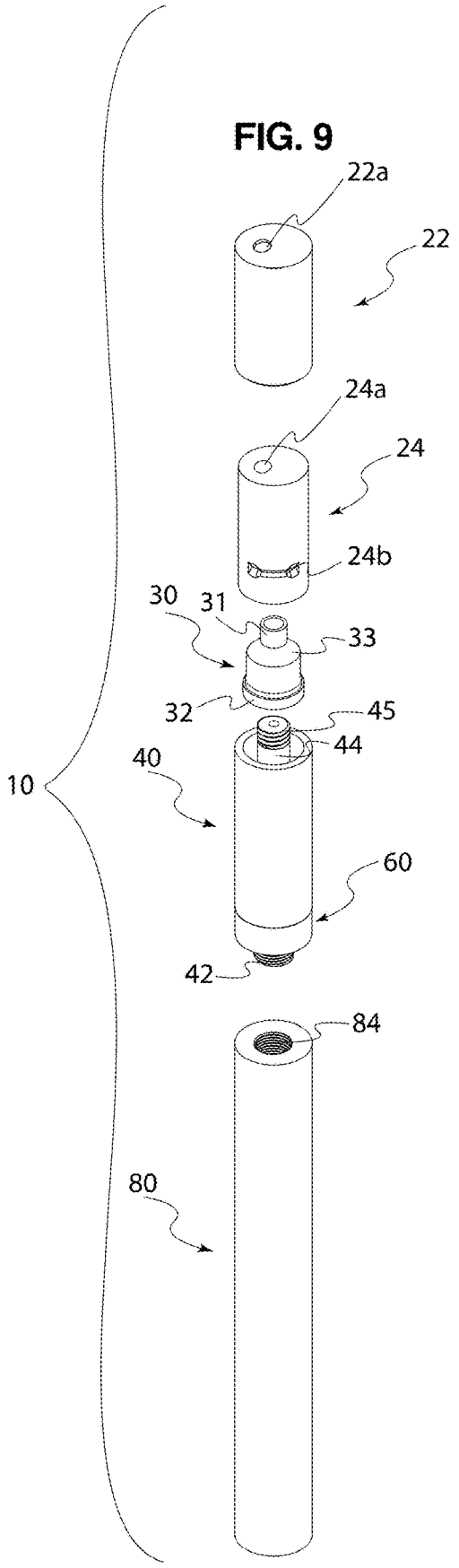
FIG. 9 is a top, exploded perspective view of the vape device shown in FIG. 1.
Figure 10:
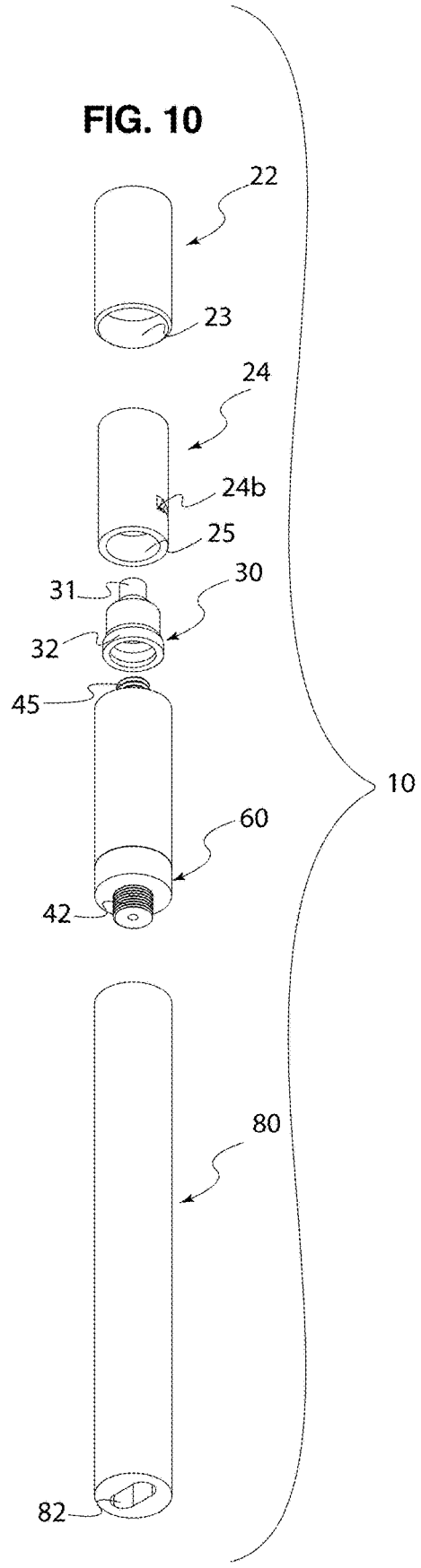
FIG. 10 is a bottom, exploded perspective view of the vape device shown in FIG. 2.
Figure 26:
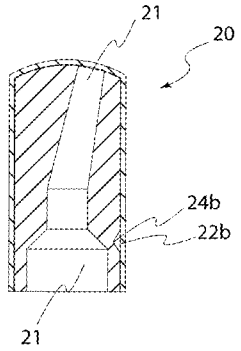
FIG. 26 is a cross-sectional view taken along the line E-E in FIG. 25.
Figure 29:
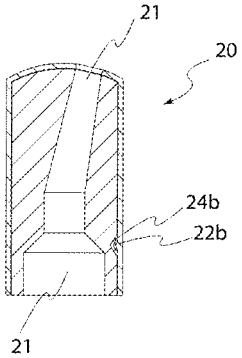
FIG. 29 is a cross-sectional view taken along the line F-F in FIG. 25.

As shown in FIG. 9, another feature of the present invention is directed to hole 22*a* being offset from a center of the upper closed end of mouthpiece 22, and hole 24*a* being offset from a center of the upper closed end of component 24. Openings 22*a*, 24*a* correspond to vaping holes which are configured to become aligned with one another in an open state of vape device 10, as further described below. When aligned, vaping holes 22*a*, 24*a* form an "airflow hole" that allows air to flow through vape device 10, which is essential for creating vapor when a user inhales during use of vape device 10. Referring to FIGS. 26 and 29, reference numeral 21 denotes the portion of the vape flow passage for vape device 10 corresponding to and provided in mouthpiece assembly 20. Flow passage portion 21 is configured to be disposed in fluid communication with vaping holes 22*a*, 24*a* (i.e., the "air flow hole") when they are aligned in the open state (first position) of vape device 10.

Figure 25:
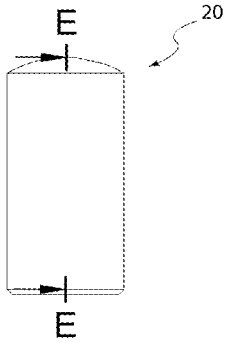
FIG. 25 is an elevational view of the mouthpiece assembly in a closed configuration.
Figure 27:
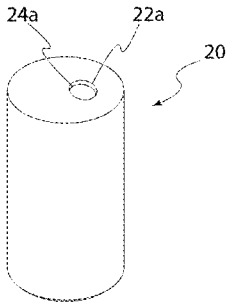
FIG. 27 is a top perspective view of the mouthpiece assembly in FIG. 25.
Figure 28:
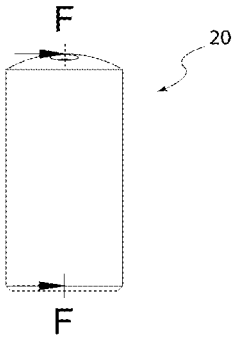
FIG. 28 is an elevational view of the mouthpiece assembly in an open configuration.
Figure 30:
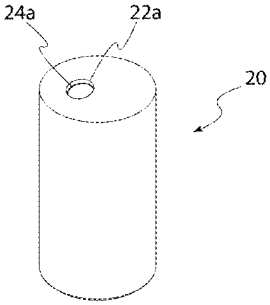
FIG. 30 is a top perspective view of the mouthpiece assembly in FIG. 28.
Figure 31:
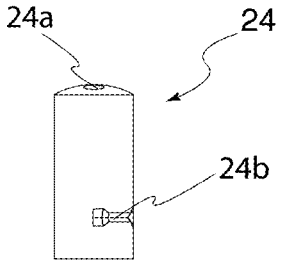
FIG. 31 is an elevational view of the interlocking component.
Figure 32:
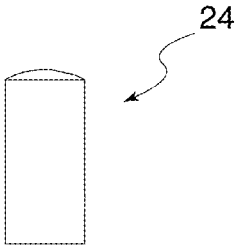
FIG. 32 is another elevational view of the interlocking component shown in FIG. 31.
Figure 33:
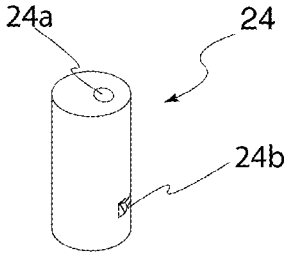
FIG. 33 is a top perspective view of the interlocking component in FIGS. 31-32.
Figure 34:
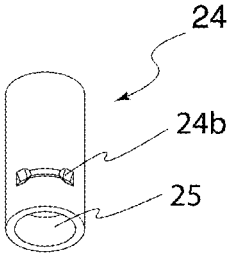
FIG. 34 is a bottom perspective view of the interlocking component in FIGS. 31-32.
Figure 35:
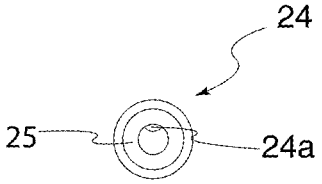
FIG. 35 is a bottom view of the interlocking component in FIGS. 31-32.
Figure 36:
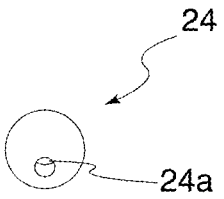
FIG. 36 is a top view of the interlocking component in FIGS. 31-32.
Figure 37:
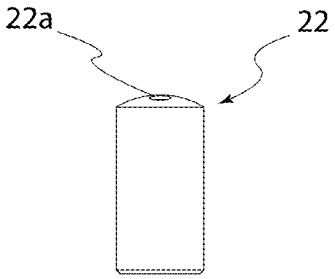
FIG. 37 is an elevational view of the mouthpiece.
Figure 38:
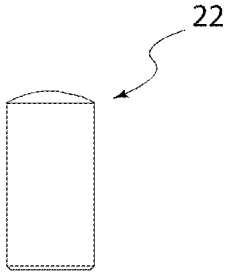
FIG. 38 is another elevational view of the mouthpiece.
Figure 39:
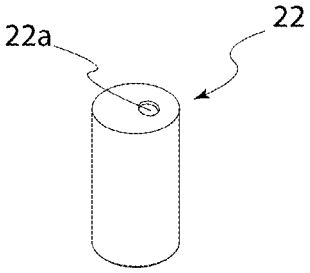
FIG. 39 is a top perspective view of the mouthpiece in FIGS. 37-38.
Figure 40:
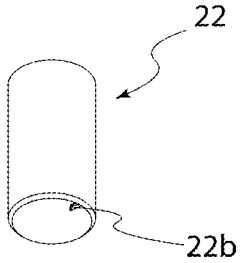
FIG. 40 is a bottom perspective view of the mouthpiece in FIGS. 37-38.
Figure 41:
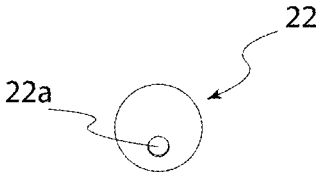
FIG. 41 is a top view of the mouthpiece in FIGS. 37-38.
Figure 42:
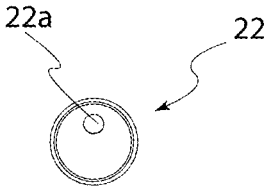
FIG. 42 is a bottom view of the mouthpiece in FIGS. 37-38.

According to another feature of the present invention, when mounted over component 24, mouthpiece 22 is configured for interlocking connection to component 24 so as to allow mouthpiece 22 to undergo rotational movement relative to component 24 between a first position, in which holes 22*a*, 24*a* are aligned with one another and with the flow passage, and a second position, in which holes 22*a*, 24*a* are not aligned with one another and with the flow passage. According to this feature of the present invention, the first position corresponds to a configuration of vape device 10 in which vape device 10 is ready for use (i.e., an open state of vape device 10), and the second position corresponds to a configuration of vape device 10 in which vape device 10 is not ready for use (i.e., a closed state of vape device 10). FIGS. 25-27 are full and cross-sectional views showing the positional relationship between mouthpiece 22 and component 24 corresponding to the closed state of vape device 10. FIGS. 28-30 are full and cross-sectional views showing the positional relationship between mouthpiece 22 and component 24 corresponding to the open state of vape device 10.

The closed and open states of device 10 as described above are achieved by respective clockwise (designated by arrow "x" in FIG. 18) and counterclockwise (designated by arrow "y" in FIG. 18) rotation of mouthpiece 22 relative to component 24 in conjunction with the feature of holes 22*a*, 24*a* being offset from respective centers of the upper closed ends of mouthpiece 22 and component 24 as described above. By this construction and corresponding functions of mouthpiece device 20 according to the present invention, the combination and corresponding configuration of mouthpiece 22 and component 24 define a rotational mechanism for opening and closing vape device 10.

There are several benefits of configuring vape device 10 so that the closed and open states are achieved by clockwise and counterclockwise rotation of mouthpiece 22 relative to component 24, including ease of use, enhanced portability, and aesthetic appeal. In terms of ease of use, this specific configuration simplifies the operation of vape device 10, as users can easily open or close it with a simple rotational movement of the mouthpiece. There are no complex mechanisms or buttons to navigate, making it intuitive for users of all experience levels. As to enhanced portability, with the rotational mechanism as described above there is no need for additional caps or covers to protect mouthpiece 22, reducing the risk of damage or loss. This makes vape device 10 more convenient to carry in pockets, bags, or purses without worrying about accidental spills. Furthermore, the seamless integration of the rotational mechanism into the design of vape device 10 contributes to its overall aesthetic appeal. It gives device 10 a sleek and streamlined appearance, enhancing its visual appeal to users.

As another feature of the present invention, the foregoing rotation of mouthpiece 22 relative to component 24 is preferably confined to a specific range of motion, ensuring that the rotation occurs within defined parameters rather than allowing for free movement. Such specific range of motion is selected so that vape device 10 is placed in the open state (first position) when mouthpiece 22 is rotated in the counterclockwise direction relative to component 24, and is placed in the closed state (second position) when mouthpiece 22 is rotated in the clockwise direction relative to component 24.

Limiting the rotation of the mouthpiece in both the clockwise and counterclockwise directions offer several benefits. By restricting the rotation, users have a clear indication of when vape device 10 is in the open or closed state. This enhances user experience by reducing confusion and ensuring straightforward operation. Furthermore, limiting the rotation helps prevent excessive wear and tear on the rotational mechanism, prolonging the lifespan of the device. It ensures that the mechanism remains reliable and functional over time, reducing the need for maintenance or repairs.

In the present embodiment, vape device 10 is configured so that rotation of mouthpiece 22 relative to component 24 is confined to 90 degrees in both the clockwise and counterclockwise directions. By this construction, consistent and controlled operation of vape device 10 is ensured. While the present invention specifies a range of motion limited to 90 degrees, it will be appreciated that alternative ranges of motion may also be suitable without deviating from the scope of the invention.

According to another feature of the present invention, and as further described below, the rotational mechanism formed by mouthpiece 22 and interlocking component 24 is provided with means for limiting rotation of mouthpiece 22 relative to component 24 in both the clockwise and counterclockwise directions as described above.

Referring to FIGS. 7, 9-11, 15-16, 18, 22-24, 26, 29, 31, 33, 34, 40, 43-46, 49 and 50, the means for limiting rotation of mouthpiece 22 comprises a cam element 22*b* formed on and extending from an inner surface portion of mouthpiece 22 and a cam follower 24*b* formed on an outer surface portion of component 24. Cam element 22*b* and cam follower 24*b* are configured with respective profile surfaces which interact to limit rotational movement between mouthpiece 22 and component 24 by controlling the transmission of motion and imposing restrictions on the range of movement as described above. As cam element 22*b* rotates (i.e., upon rotation of mouthpiece 22 relative to component 24), its surface comes into contact with the surface of cam follower 24*b*, with cam follower 24*b* maintaining contact with the surface of cam element 22*b*. The interaction between cam element 22*b* and cam follower 24*b* allows for precise control over the rotational movement of mouthpiece 22 while enabling restrictions on the range of rotational motion to be imposed between mouthpiece 22 and component 24. This feature is particularly useful in mouthpiece assembly 20 of the present invention where precise positioning or limited movement is required to place mouthpiece assembly in the open state (first position) and closed state (second position) as noted above and further described below.

According to the present invention, the shapes, profiles and corresponding dimensions for cam element 22*b* and cam follower 24*b* are selected to ensure that cam element 22*b* follows the surface profile (e.g., contours) of cam follower 24*b* while restricting the range of rotational movement between mouthpiece 22 and interlocking component 24 as described above. To accomplish this, cam follower 24*b* incorporates mechanical stops 24*c*, 24*d*, as shown for example in FIG. 24, to limit the range of rotational motion of cam element 22*b*, and thus the range of rotational motion of mouthpiece 22.

In the example of the present embodiment described above, the range of rotational motion of mouthpiece 22 relative to component 24 is limited to 90 degrees both in the clockwise and counterclockwise directions of movement of mouthpiece 22. In this embodiment, the shape, profile and corresponding dimensions of cam follower 24*b* are selected so that mechanical stops 24*c*, 24*d* are positioned and configured to limit or restrict movement of mouthpiece 22 relative to component 24 within 90 degrees both in the clockwise and counterclockwise directions, as described above. Mechanical stops 24*c*, 24*d* are configured to physically block movement of cam element 22*b* when it reaches the corresponding 90-degree position, preventing further motion. The positions of mechanical stops 24*c*, 24*d* of cam follower 24*b* and the corresponding 90-degree movement limitation for cam element 22*b* are configured so that vape holes 22*a*, 24*a* of mouthpiece 22 and component 24, respectively, are aligned with one another and with the flow passage in the open state (first position) of mouthpiece assembly 20 when mouthpiece 22 is fully rotated 90 degrees in the counterclockwise direction, and so that vape holes 22*a*, 24*a* are not aligned with one another and with the flow passage in the closed state (second position) of mouthpiece assembly 20 when mouthpiece 22 is fully rotated 90 degrees in the clockwise direction. As described above, the 90-degree movement limitation can be varied as desired without departing from the objectives and scope of the present invention.

In the present embodiment, each of mouthpiece 22 and component 24 of mouthpiece assembly 20 has a unitary construction formed from a single piece of material. The choice of materials for mouthpiece 22 and component 24 depends on various factors, including safety, durability, comfort, and aesthetics. For example, each of mouthpiece 22 and component 24 can be made of suitable plastic or metal materials. Plastic materials such as acrylic and polycarbonate are suitable for mouthpiece assembly 20 due to their affordability, lightweight nature, and ease of molding into various shapes. As a metal material, stainless steel is a durable and corrosion-resistant material that offers a sleek and modern aesthetic for mouthpiece assembly 20. Stainless steel also provides a solid feel and can be easily cleaned and sterilized.

According to another aspect of the present invention, mouthpiece assembly 20 is suitable for use as a retrofittable or interchangeable mouthpiece for existing vape devices. This can be achieved, for example, by adapting component 24 for removable connection to tank 40 either directly or via adapter 30 or atomizer 44. As a retrofit, mouthpiece 20 can incorporate an adaptive attachment mechanism that enables it to be securely yet removably attached to existing vape devices. This mechanism may include features such as threaded connectors, snap-on clips, or magnetic attachments, for example, that allow mouthpiece assembly 20 to be easily installed and removed as needed. As a retrofit, mouthpiece assembly 20 is therefore configured for quick and secure installation to existing vape devices, requiring minimal tools or technical expertise.

As a retrofit, mouthpiece assembly 20 is designed to have a universal fit, meaning it can be adapted for attachment to a wide range of existing vape devices regardless of their brand, model, or size. This ensures compatibility with a broad range of devices, allowing users to upgrade and customize their vaping experience without needing to purchase a new device.

Mouthpiece assembly 20 according to the present invention also offers an excellent opportunity for customizable aesthetics, including color and texture options. More specifically, mouthpiece 22 and interlocking component 24 of mouthpiece assembly 20 can be manufactured in a variety of colors to suit users' preferences and style preferences. This allows users to personalize their vaping experience and express their individuality.

In addition to color, the texture of mouthpiece 22, for example, can also be customized to provide users with a unique tactile experience. Smooth, glossy finishes offer a sleek and modern look, while textured surfaces, such as knurling or patterns, can provide added grip and visual interest. Matte finishes offer a subtle and understated aesthetic, while rubberized coatings provide a soft and comfortable feel in the hand.

Mouthpiece assembly 20 is also suitable for custom branding, such as for use as a promotional item. For example, the external surface of mouthpiece 22 may be provided with various types of business logos or branding elements. This would help promote brand recognition and loyalty among users and create a cohesive brand identity for vape devices equipped with mouthpiece assembly 20.

The retrofittable aspect of mouthpiece assembly, including the foregoing features and advantages, allows users to swap out different mouthpiece designs from vape devices to suit their mood or style preferences. This modular approach provides users with flexibility and allows them to change the look of their vape device without having to replace the entire device.

Moreover, mouthpiece assembly according to the present invention is particularly suitable for manufacture and release as limited edition or special edition mouthpieces featuring unique designs, patterns, or collaborations with artists or brands. These exclusive releases can generate excitement among users and collectors and create a sense of exclusivity around the product.

It will be appreciated from the disclosure of the present invention that mouthpiece assembly 20 is also configured to function as a cover for selectively covering or closing flow passage 21 when vape device 10 is not being used (i.e., in the first position or closed state of vape device 10). This eliminates the requirement for additional cover elements which reduces the overall dimensions as well as manufacturing costs for vape device 10. Mouthpiece assembly 20 functions as a cover to help keep the vape device 10 clean when it's not in use. This is especially important when vape device 10 is carried around in a bag or pocket where it can come into contact with dirt, dust, or other debris. Furthermore, vape devices may leak small amounts of e-liquid, particularly when they are being transported or stored. In the closed state, mouthpiece assembly 20 helps contain any leaks and prevent them from getting onto the user's clothes, furniture, or other belongings.

By functioning as a cover, mouthpiece assembly 20 of vape device 10 serves a crucial role in maintaining the integrity and functionality of vape device 10 when it is not in use. This feature is designed to ensure that when vape device 10 is in its closed state, no fumes or odors can escape from the cartridge. This not only enhances the user experience but also provides several significant advantages, including preservation of e-liquid quality, odor control, leak prevention, safety and hygiene, enhanced portability, and longer device lifespan, as further described below:

- By sealing the flow passage, mouthpiece assembly 20 helps to maintain the quality and potency of the e-liquid within the cartridge. Exposure to air can lead to the oxidation of the e-liquid, potentially degrading its flavor and reducing its effectiveness. A sealed environment minimizes this risk, ensuring that the e-liquid remains fresh and consistent in taste.
- Vaping devices often contain aromatic substances that, when not properly sealed, can release lingering odors. By preventing the escape of fumes and odors, mouthpiece assembly 20 helps to maintain a more discreet and pleasant environment for the user and those around them. This is particularly beneficial in settings where the user may want to avoid drawing attention to their vaping habits or where strong scents might be undesirable.
- One of the most practical benefits of mouthpiece assembly functioning as a cover for flow passage 21 is the prevention of leaks as described above. A securely closed flow passage minimizes the chances of e-liquid seeping out of the cartridge, which could otherwise cause messes or damage to personal belongings such as clothing, bags, or electronic devices. This is particularly important during transport or when the device is stored in a pocket or bag.
- The cover function exhibited by mouthpiece assembly 20 also contributes to the overall safety and hygiene of the vape device. By closing flow passage 21, mouthpiece assembly 20 prevents dust, debris, and other contaminants from entering vape device 10, which could otherwise affect the performance of the vape or pose a health risk to the user. Additionally, this feature can help to prevent accidental activation of the device, which could lead to unintentional exposure to the e-liquid or unnecessary battery drain.
- Users who carry their vape devices with them throughout the day will appreciate the added portability that comes with a sealed flow passage. Without the worry of leaks or odors escaping, users can confidently transport their device without the need for additional protective cases or measure
- By preventing leaks and protecting the internal components from external contaminants, mouthpiece assembly 20 contributes to the longevity of vape device 10. This can result in fewer maintenance issues and a longer overall lifespan for the device, providing better value and reliability for the user.

In summary, the ability of mouthpiece assembly 20 to close flow passage 21 in the closed state of vape device 10 offers multiple benefits that enhance the user experience, protect the device, and ensure that the vape remains an effective and enjoyable tool for its intended purpose.

Moreover, traditional smoking involves a two-step process where the user must light something to burn tobacco or marijuana. In contrast, vaporizers automatically deliver vapor once the user inhales from the intake hole. This feature bypasses a crucial safety mechanism, as it removes the need for the user to actively light something before inhaling. Furthermore, conventional smoking requires the user to ignite a substance, which demands motor skills and a conscious understanding of the act of smoking. However, with a vaporizer, anyone who gains access to the device can inhale vapor without the need to light or burn anything. This is why it is essential to have a protective barrier over the intake hole to prevent unintended use.

The cover function of mouthpiece assembly 20 according to the present invention plays a crucial role in promoting child safety by providing a physical barrier that prevents unintended access to the vape device. When mouthpiece assembly 20 is in its closed position, it effectively seals the flow passage, making it difficult for children or unauthorized users to access the device and inhale from it. This feature addresses several key aspects of child safety, including prevention of accidental inhalation, deterrence of unintended use, protection against tampering, reduction of exposure to residual vapors, and promotion of safe storage, as further described below:

- By covering the intake hole when the device is not in use, mouthpiece assembly 20 helps prevent accidental inhalation of vapor by children. Since the flow passage is closed, even if a child were to pick up the device and attempt to use it, they would be unable to inhale anything. This minimizes the risk of accidental exposure to harmful substances such as nicotine or marijuana.
- The cover function of mouthpiece assembly 20 adds an additional layer of complexity that deters children from using the device. A child is less likely to figure out how to open or remove the cover, especially if the mechanism requires more advanced motor skills or cognitive understanding. This reduces the likelihood of a child unintentionally using the vaporizer.
- The cover according to the present invention acts as a tamper-evident feature, making it more apparent if someone has attempted to access the device. Parents or guardians can more easily monitor whether the device has been tampered with, providing an added level of security and peace of mind.
- As described above, even when not in active use, vaporizers can sometimes emit residual vapors or odors. By sealing the flow passage, mouthpiece assembly 20 prevents these residual fumes from escaping, thereby reducing the chances of a child being exposed to harmful substances.
- The presence of a cover according to the present invention encourages users to properly close and store the device when it is not in use. This habit promotes a safer environment by ensuring that the vape device is less accessible to children, particularly in households where such devices are present.

In summary, the cover function of mouthpiece assembly 20 according to the present invention enhances child safety by providing a secure barrier that prevents accidental or unintended use of the vaporizer. This feature helps protect children from the risks associated with inhaling harmful substances, making it an essential component of a child-safe vaping device.

FIGS. 51-73 illustrate another embodiment of a mouthpiece assembly, generally designated at 100, for a vaporizer apparatus, according to the present invention. The mouthpiece assembly 100 is configured to control airflow through a selectively openable mouthpiece aperture 102*a*, while also providing an efficient locking mechanism for stable use.

The mouthpiece assembly 100 includes an external case 102, which may be formed as a tubular member. The external case 102 defines an interior space 102*d* within which other components of the mouthpiece assembly are housed. The mouthpiece aperture 102*a*, through which vapor exits during inhalation by the user, is provided at the top of the external case 102.

The external case 102 further includes a slot 102*b* extending along a portion of its side surface. Slot 102*b* is dimensioned to allow movement of a side-actuated sliding module 110, as described further below. The external case 102 also defines an intake aperture 102*c*, which serves as a vape hole allowing vapor to pass into the interior space 102*d* and towards the mouthpiece aperture 102*a*. The intake aperture 102*c* includes a tapered portion 102*e* to promote increased airflow around the sliding module and towards the mouthpiece aperture 102*a*.

The interior surface of the external case 102 is provided with a top divot slot 104 and a bottom divot slot 106. These divots act as engagement features for a spring-biased locking portion of the sliding module 110, thereby enabling the module to be temporarily locked in either a fully open or fully closed position.

The sliding module 110 is movably mounted within the interior space 102*d* of the external case 102. The sliding module (110) is configured for movement between an upper position (closing mouthpiece aperture 102*a*) and a lower position (opening mouthpiece aperture 102*a*). Movement of the sliding module 112 is effected by the user through a side button 120, which protrudes through the slot 102*b* of the external case 102 and is accessible from the exterior of the mouthpiece assembly 100.

Figure 69:
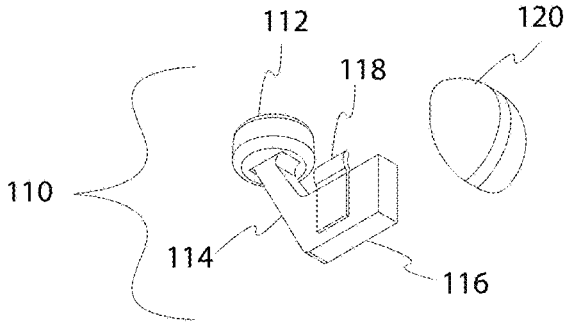
FIG. 69 is an exploded view of a sliding mechanism for the assembly of this embodiment.
Figure 70:
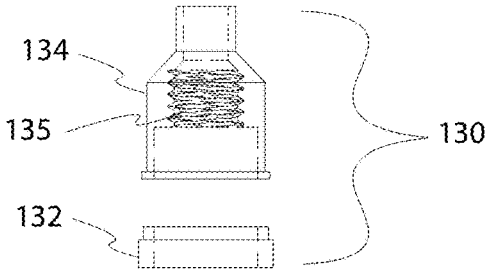
FIG. 70 is an exploded view of an adapter for the assembly of this embodiment.
Figure 71:
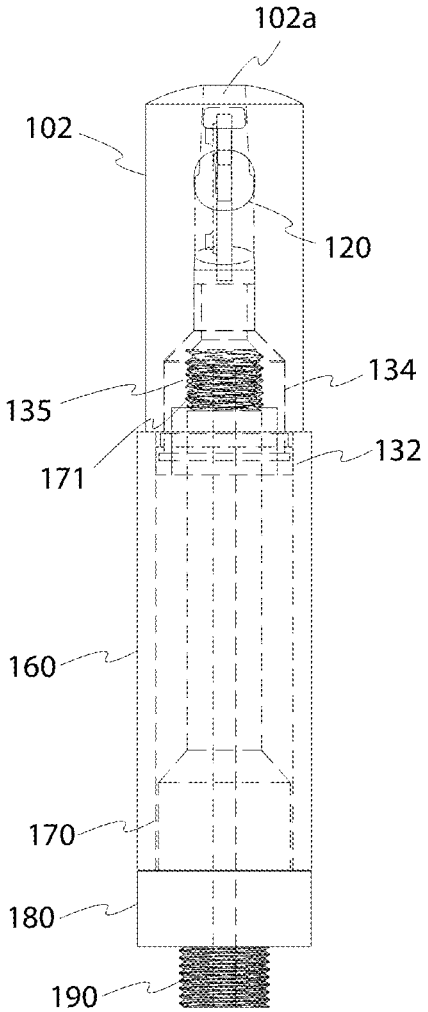
FIG. 71 is a front elevational view of the assembly shown in FIG. 52, illustrating an arrangement in which a tank containing an atomizer is mounted to the adapter, the view being presented with certain components shown as transparent in order to better illustrate various internal features of the assembly, tank and atomizer.
Figure 72:
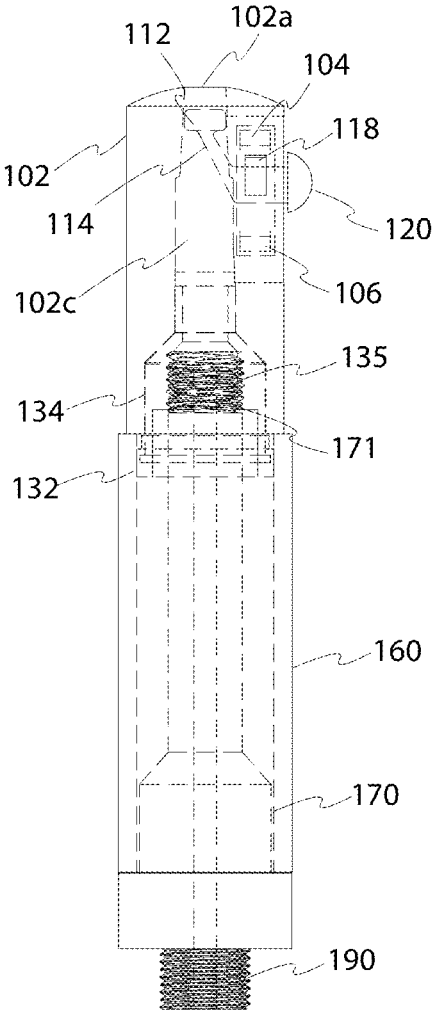
FIG. 72 is a left-side view of the arrangement illustrated in FIG. 71.
Figure 73:
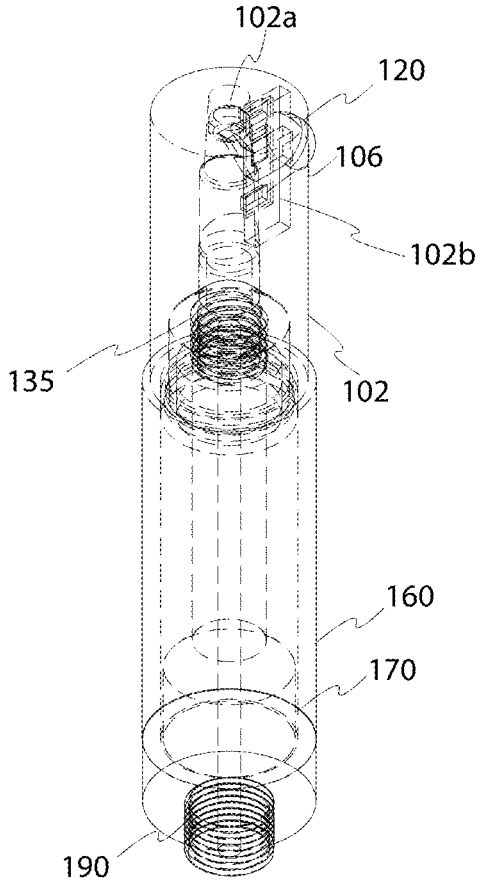
FIG. 73 is a perspective view of the arrangement illustrated in FIG. 71.
Figure 74:
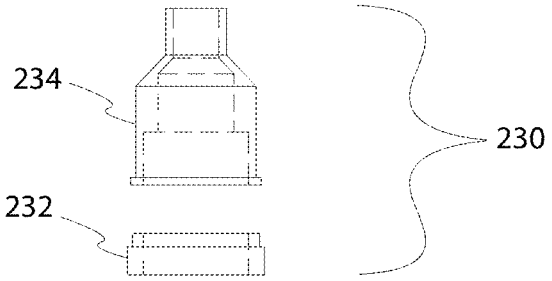
FIG. 74 is an exploded view of a modified form of the adapter shown in FIG. 70.
Figure 75:
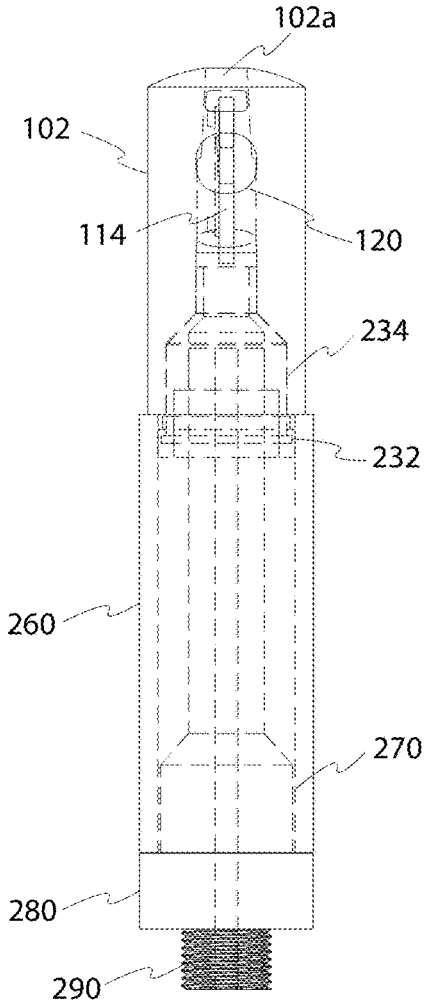
FIG. 75 is a view similar to the arrangement illustrated in FIG. 71, except that this arrangement incorporates the adapter of FIG. 74 instead of the adapter of FIG. 70.
Figure 76:
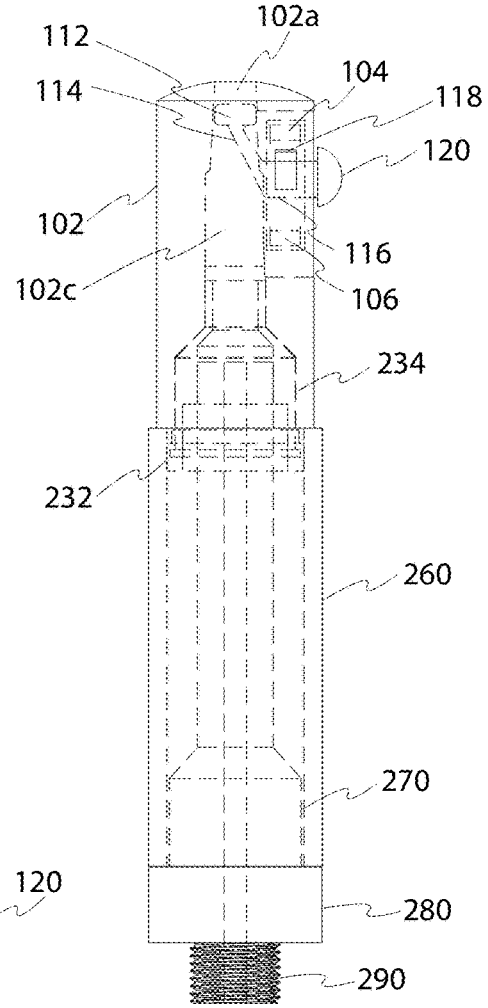
FIG. 76 is a view similar to the arrangement illustrated in FIG. 72, except that this arrangement incorporates the adapter of FIG. 74 instead of the adapter of FIG. 70.
Figure 77:
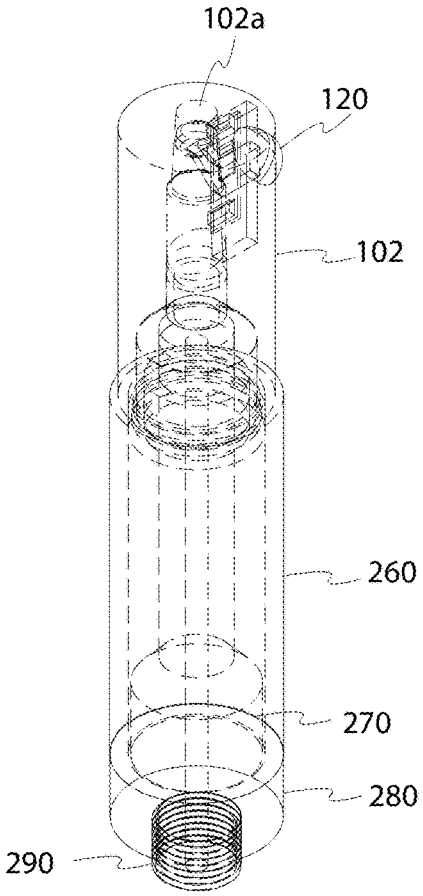
FIG. 77 is a view similar to the arrangement illustrated in FIG. 73, except that this arrangement incorporates the adapter of FIG. 74 instead of the adapter of FIG. 70.
Figure 78:
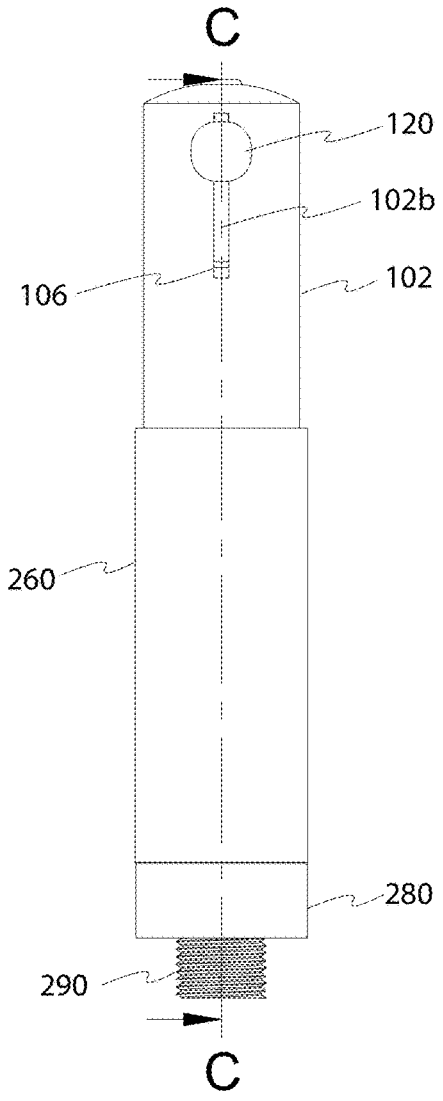
FIG. 78 is an elevational view similar to FIG. 75, illustrating the external visible surfaces components.

Referring to FIG. 69, the sliding module 110 includes a top part 112, which is generally flat on its upper surface such that, when the sliding module is in the upper position, the top part 112 is flush with the external case and closes the mouthpiece aperture 102*a*. Extending downward from the top part 112 is a first portion 114, which is inclined or tapered upward toward the top part 112. This taper of the first portion 114 is designed to improve airflow dynamics, channeling vapor more efficiently upward toward the mouthpiece aperture 102*a*. A second portion 116 extends from the first portion 114 and provides support for both the side button 120 and an interlocking portion 118.

The interlocking portion 118 comprises a generally U-shaped spring element securely attached on the second portion 116. The interlocking portion 118 is biased outwardly to selectively engage with the top divot slot 104 and the bottom divot slot 106 of the external case 102. When the sliding module 110 is moved to the upper position, as shown in FIGS. 51-58, the interlocking portion 118 engages the top divot slot 104, thereby holding the sliding module in a locked, closed position that prevents airflow through the mouthpiece aperture 102*a*. When the sliding module 110 is moved downward to the lower position, as shown in FIGS. 59-64, the interlocking portion 118 engages the bottom divot slot 106, thereby holding the sliding module in a locked, open position in which airflow is permitted from the intake aperture 102*c* through the interior space 102*d* and out the mouthpiece aperture 102*a*.

According to a feature of the present invention, the sliding module 110 is also configured to facilitate cleaning by pushing accumulated waste or residue upward and out of the mouthpiece aperture 102*a* when shifted between positions.

Referring to FIGS. 65, 66 and 70-73, the mouthpiece assembly 100 further includes an adapter 130 for connection to an atomizer 170 of the vaporizer apparatus. The adapter 130 includes a metal insert 134 and a gasket 132 connected to the metal insert to ensure airtight sealing during use. The metal insert 134 is provided with an inner female thread 135 dimensioned for threaded engagement with a corresponding outer male thread 171 of the atomizer 170. This arrangement ensures a secure connection between the mouthpiece assembly 100 and the atomizer 170, while also preventing vapor leakage. The metal insert 134 is securely mounted within the interior space 102*d* of the external case 102. The gasket 132 is likewise securely affixed to the metal insert 134.

The mouthpiece assembly 100 is connected to a tank 160 via the adapter 130. The tank 160 is formed as a tubular member configured to contain an e-liquid, also referred to as vape juice or e-juice. The tank 160 is further configured to receive and house an atomizer 170, which incorporates a heating element 180, such as a coil or atomizer head. The heating element 180 is coupled to a power supply (not shown) through a threaded section 190. Upon activation of the power supply, the heating element 180 is energized to heat and vaporize the e-liquid contained within the tank 160. The configuration of the tank 160, atomizer 170, and power supply for use with the mouthpiece assembly 100 of the present embodiment corresponds generally to the tank 40, atomizer 44, and power supply 80 described in connection with the embodiment illustrated in FIGS. 1-10.

Figure 79:
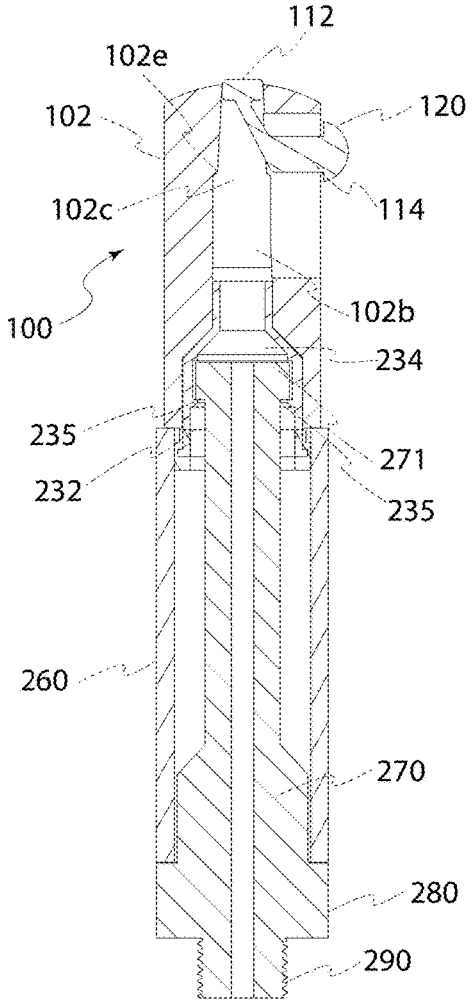
FIG. 79 is a cross-sectional view taken along the line C-C in FIG. 78.
Figure 80:
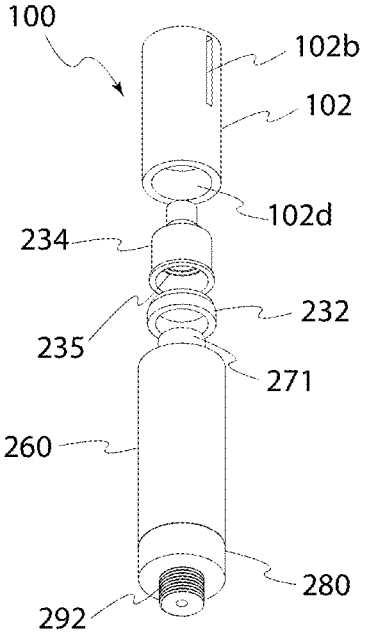
FIG. 80 is an exploded view in perspective of the assembly in FIG. 78.
Figure 81:
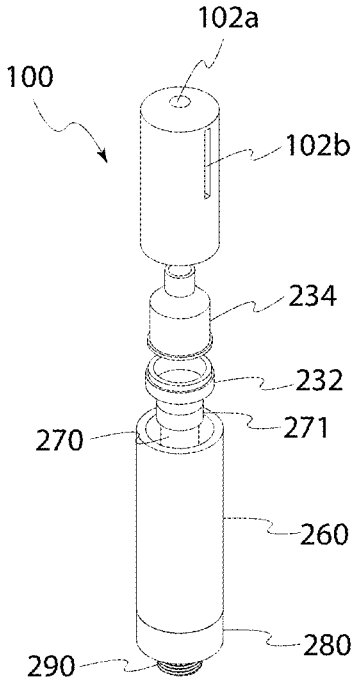
FIG. 81 is another exploded view in perspective of the assembly in FIG. 78.

FIGS. 74-81 illustrate a modification of the embodiment shown in FIGS. 51-73. In this modified embodiment, the mouthpiece assembly includes an adapter 230 that is configured for connection to the atomizer 170 via a snap-fit engagement, rather than a threaded connection. The adapter 230 includes a gasket 232 and a metal insert 234. As shown in FIG. 79, the metal insert 234 defines an inner collar portion 235 that is dimensioned and configured to engage with a corresponding outer collar portion 271 of the atomizer 270 to form a secure snap-fit connection. The snap-fit engagement between the inner collar portion 235 of the metal insert 234 and the outer collar portion 271 of the atomizer 270 provides a stable and airtight connection, ensuring proper operation of the vaporizer apparatus without the need for threaded coupling. Except for the use of the snap-fit engagement in place of threading, all other structural and functional details of the adapter 230 correspond to those of the adapter 130 described above with reference to FIGS. 51-73.

The mouthpiece assembly 100 may be manufactured and assembled using a variety of conventional and advanced techniques. The choice of assembly method depends on the selected materials and the desired balance of strength, sealing, durability, and ease of manufacture.

The external case 102 may be formed by injection molding (for plastics such as acrylic or polycarbonate) or precision machining (for metals such as stainless steel or aluminum alloys). Surface finishing processes such as polishing, anodizing, or coating may be applied to enhance durability and aesthetics.

The sliding module 110, including the top part 112, first portion 114, second portion 116 and side button 120, may be produced by molding or machining depending on the material used. In an exemplary embodiment, the top part 112, first portion 114, and second portion 116 of the sliding module 110 are molded from a single piece of material. The side button 120 is securely affixed to a free end of the second portion 116 by adhesive bonding, press-fit engagement, welding, soldering, or other suitable attachment means. The sliding module is dimensioned for a close but smooth fit within the interior space 102*d* of the external case 102, enabling controlled sliding movement.

Figure 66:
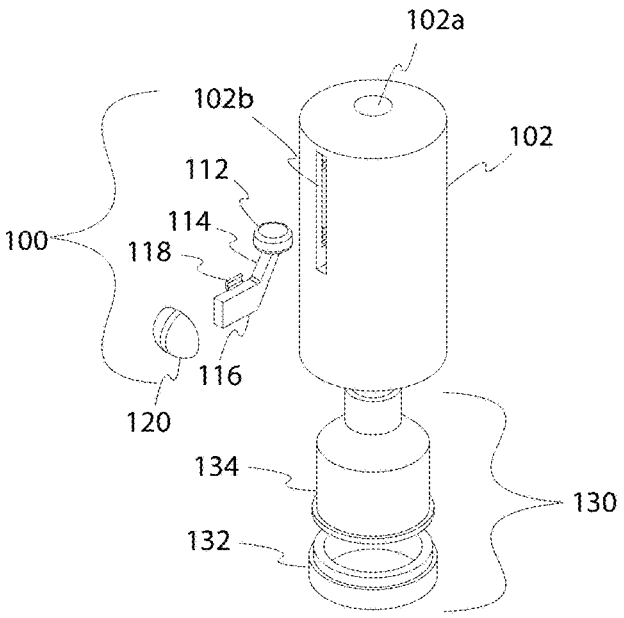
FIG. 66 is another exploded perspective view of the assembly illustrated in FIGS. 51-64.
Figure 67:
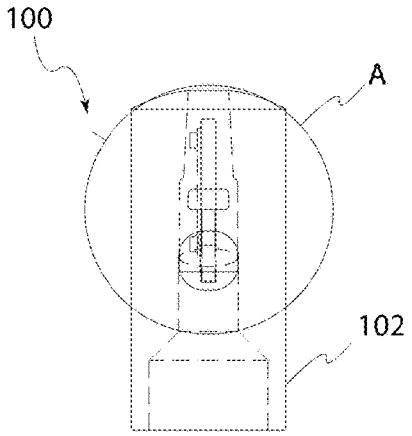
FIG. 67 is a front view of a mouthpiece for the assembly in this embodiment, the view being presented with certain components shown as transparent in order to better illustrate various internal features of the mouthpiece.
Figure 68:
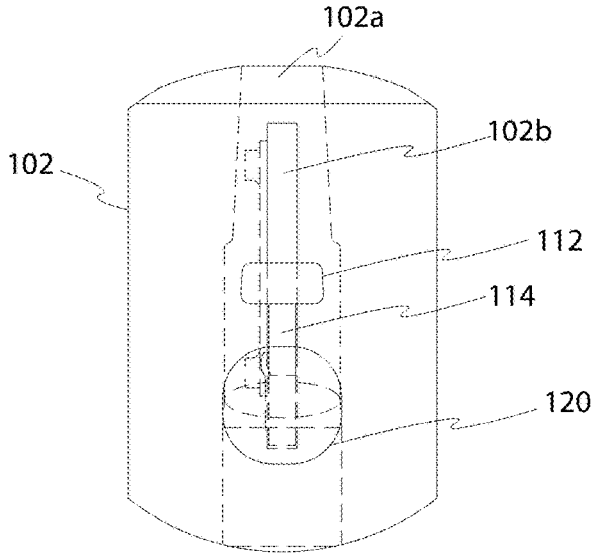
FIG. 68 is an enlarged view of section A shown in FIG. 67, providing a more detailed illustration of the features within the highlighted area.

The interlocking portion 118, which is preferably a U-shaped spring element, may be manufactured from spring steel or stainless steel using stamping, bending, or wire-forming techniques. The interlocking portion 118 is securely affixed to the second portion 116 of the sliding module 110, as shown in FIGS. 66 and 69, by adhesive bonding, press-fit engagement, welding, soldering, or other suitable attachment means.

The metal insert 134, 234 of the adapter 130, 230 may be machined or die-cast and is securely mounted within the interior space 102*d* of the external case 102 by adhesive bonding, press-fit, snap-fit engagement, welding, or other suitable attachment means. The gasket 132, 232 is securely affixed to the metal insert 134, 234 using adhesive, thermal bonding, or overmolding processes to ensure airtight sealing. As described above, in the embodiment of adapter 130, threaded engagement is provided between the inner female thread 135 of the insert 134 and the outer male thread 171 of the atomizer 170. In the embodiment of adapter 230, the inner collar portion 235 of the insert 234 is configured to snap-fit with the outer collar portion 271 of the atomizer 270.

The embodiment of the mouthpiece assembly 100 incorporating the sliding module 110 provides several advantages over conventional mouthpiece designs. The sliding module 110, actuated by the side button 120, enables a user to easily open and close the mouthpiece aperture 102*a* with one hand, thereby improving convenience and usability. The interlocking portion 118, configured to selectively engage the top and bottom divot slots 104, 106, provides reliable locking in both the open and closed positions, preventing unintentional movement during use. In the open state, the tapered portion 114 of the sliding module 110 and the tapered portion 102*e* of the intake aperture 102*c* cooperate to optimize airflow dynamics, allowing vapor to flow smoothly with minimal restriction. In addition, the sliding motion of the module 110 assists in clearing residue or waste buildup from the intake aperture 102*c*, thereby contributing to easier cleaning and improved hygiene. The overall design thus combines secure operability, enhanced airflow efficiency, and self-cleaning functionality, resulting in a more reliable and user-friendly vaporizer mouthpiece.

The embodiments of the adapter 130, 230 likewise provide distinct advantages. In the threaded embodiment 130, the metal insert 134 with its inner female thread 135 ensures a secure and airtight connection with the outer male thread 171 of the atomizer 170, allowing reliable attachment and detachment during refilling or maintenance. The inclusion of the gasket 132 further enhances sealing performance, preventing vapor or e-liquid leakage. In the snap-fit embodiment 230, the inner collar portion 235 of the metal insert 234 engages with the outer collar portion 271 of the atomizer 270 to provide a quick-connect mechanism that eliminates the need for threading. This configuration allows for faster assembly and disassembly, while still maintaining a robust and airtight seal via the gasket 232. Both adapter embodiments therefore improve ease of use, facilitate maintenance and cleaning, and ensure reliable sealing and stability of the connection between the mouthpiece assembly 100 and the atomizer 170, 270.

Mouthpiece assembly 100 of the embodiments of FIGS. 51-73 and FIGS. 74-81 provides significant advantages by functioning as a cover for the mouthpiece opening 102*a* and intake aperture 102*c* in the closed state. In this configuration, mouthpiece assembly 100 helps preserve e-liquid quality by minimizing exposure to air, prevents the escape of odors or vapors, and reduces the risk of leaks during transport or storage. The cover feature also enhances hygiene and safety by blocking dust, debris, and other contaminants from entering the device, while contributing to device longevity through protection of internal components. In addition, by sealing the mouthpiece opening 102*a* and intake aperture 102*c*, mouthpiece assembly 100 promotes child safety by serving as a physical barrier that deters unintended access, accidental inhalation, and tampering. Collectively, these benefits improve portability, reliability, and overall user experience, while supporting safer and more responsible use of the vaping device.

The mouthpiece assembly 100 of the present embodiments also provides significant opportunities for customizable aesthetics, allowing users to personalize the appearance and tactile experience of their vaporizer device. For example, the external case 102 may be manufactured in a variety of colors to suit individual style preferences. In addition, the surfaces of the mouthpiece assembly 100 can be finished with a range of textures, including smooth, glossy finishes for a sleek appearance, matte finishes for a subtle aesthetic, textured patterns or knurling for improved grip and visual interest, and soft or rubberized coatings for enhanced comfort during use.

The mouthpiece assembly 100 is also suitable for custom branding and promotional applications. Logos, trademarks, or other design elements may be applied to the external surfaces of the external case 102, for example, supporting brand recognition and loyalty. These customization options apply equally to both the threaded adapter embodiment (130) and the snap-fit adapter embodiment (230), allowing the complete mouthpiece assembly to present a cohesive, user-personalized, and visually distinctive device.

Reference in the specification to "one embodiment" or "an embodiment" of the present invention, as well as other variations thereof, means that a particular feature, structure, characteristic, and so forth described in connection with the embodiment is included in at least one embodiment of the present invention. Thus, the appearances of the phrase "in one embodiment" or "in an embodiment", as well any other variations, appearing in various places throughout the specification are not necessarily all referring to the same embodiment. However, it is to be appreciated that features of one or more embodiments can be combined given the teachings of the present invention provided herein.

The foregoing is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the present invention and that those skilled in the art may implement various modifications without departing from the scope and spirit of the invention. Those skilled in the art could implement various other feature combinations without departing from the scope and spirit of the invention. Having thus described aspects of the invention, with the details and particularity required by the patent laws, what is claimed and desired protected by Letters Patent is set forth in the appended claims.

What is claimed is:

1. A mouthpiece assembly for a vaporizer apparatus, the mouthpiece assembly comprising:

an external case having an interior space, a mouthpiece aperture at an upper end, and an intake aperture that allows vapor to pass into the interior space and towards the mouthpiece aperture; and a sliding module movably mounted within the interior space of the external case and configured for undergoing sliding movement between an upper position closing the mouthpiece aperture and a lower position opening the mouthpiece aperture, the sliding module including an interlocking portion configured to engage with corresponding engagement portions in the interior space of the external case to selectively lock the sliding module in the upper position or the lower position.

2. The mouthpiece assembly of claim 1, wherein the interior space of the external case includes a top divot slot and a bottom divot slot; and wherein the interlocking portion of the sliding module comprises a spring element configured to selectively engage with the top divot slot when the sliding module is in the upper position and with the bottom divot slot when the sliding module is in the lower position, thereby temporarily locking the sliding module in the respective position.

3. The mouthpiece assembly of claim 1, wherein the external case has a slot extending along a side surface thereof; and wherein the sliding module includes a first portion that slides along the slot, a second portion extending from the first portion, and a side button mounted on the second portion, the side button extending outwardly through the slot to permit user actuation of the sliding module between the upper and lower positions.

4. The mouthpiece assembly of claim 1, wherein the sliding module further comprises:

a top part having an upper surface configured to close the mouthpiece aperture when the sliding module is in the upper position;

a first portion extending from the top part; and a second portion extending from the first portion and configured for sliding along a slot of the external case, the second portion supporting a side button that extends outwardly through the slot to permit user actuation of the sliding module between the upper and lower positions.

5. The mouthpiece assembly of claim 4, wherein the first portion extends from the second portion in an inclined manner toward the top part, the inclined first portion being configured to improve airflow dynamics within the interior space of the external case and to channel vapor more efficiently upward toward the mouthpiece aperture.

6. The mouthpiece assembly of claim 1, wherein movement of the sliding module between the upper position and the lower position is configured to push waste or residue accumulated in the intake aperture upward and out of the mouthpiece aperture.

7. A vaporizer apparatus, comprising:

the mouthpiece assembly of claim 1;

an atomizer configured to receive and vaporize an e-liquid, the atomizer including a heating element operable to vaporize the e-liquid when energized by a power supply; and an adapter configured to connect the mouthpiece assembly to the atomizer and to provide an airtight connection therebetween;

wherein vapor generated by the atomizer passes through the intake aperture and out of the mouthpiece aperture of the mouthpiece assembly for inhalation by a user.

8. The vaporizer apparatus of claim 7, wherein the adapter includes a metal insert and a gasket affixed to the metal insert to provide the airtight connection, and wherein the metal insert has an inner female thread configured for threaded engagement with a corresponding outer male thread of the atomizer.

9. The vaporizer apparatus of claim 7, wherein the adapter includes a metal insert and a gasket affixed to the metal insert to provide the airtight connection, and wherein the metal insert has an inner collar portion configured for snap-fit engagement with a corresponding outer collar portion of the atomizer.

10. A mouthpiece assembly for a vaporizer apparatus, the mouthpiece assembly comprising:

an external case defining an interior space, a mouthpiece aperture at an upper end, and an intake aperture allowing vapor to pass into the interior space and toward the mouthpiece aperture; and a sliding module mounted within the interior space of the external case, the sliding module including a top part configured to close the mouthpiece aperture, a first portion extending from the top part, a second portion extending from the first portion, and a side button mounted on the second portion and extending through a slot of the external case, the sliding module being configured to move between a closed position in which the top part closes the mouthpiece aperture and an open position in which vapor can flow from the intake aperture to the mouthpiece aperture, and the side button being operable by a user to move the sliding module between the closed position and the open position.

11. The mouthpiece assembly of claim 10, wherein the sliding module further includes an interlocking portion configured to engage with engagement portions in the interior space of the external case to temporarily lock the sliding module in the closed position or the open position.

12. The mouthpiece assembly of claim 11, wherein the interlocking portion comprises a spring element securely mounted on the second portion and biased outwardly to engage with corresponding engagement portions in the interior space of the external case.

13. The mouthpiece assembly of claim 11, wherein the interior space of the external case includes a top divot slot and a bottom divot slot, and wherein the interlocking portion is configured to selectively engage with the top divot slot in the closed position and the bottom divot slot in the open position.

14. The mouthpiece assembly of claim 10, wherein for the sliding module, the first portion extends from the second portion in an inclined manner toward the top part; and wherein movement of the sliding module between the closed position and the open position is configured to push waste or residue accumulated in the intake aperture upward and out of the mouthpiece aperture.

15. A vaporizer apparatus, comprising:

the mouthpiece assembly of claim 10;

an atomizer configured to receive and vaporize an e-liquid, the atomizer including a heating element operable to vaporize the e-liquid when energized by a power supply; and an adapter configured to connect the mouthpiece assembly to the atomizer and to provide an airtight connection therebetween;

wherein vapor generated by the atomizer passes through the adapter through the intake aperture and out of the mouthpiece aperture of the mouthpiece assembly for inhalation by a user.

16. The vaporizer apparatus of claim 15, wherein the adapter has an inner female thread configured for threaded engagement with a corresponding outer male thread of the atomizer.

17. The vaporizer apparatus of claim 15, wherein the adapter has an inner collar portion configured for snap-fit engagement with a corresponding outer collar portion of the atomizer.

18. A vaporizer apparatus comprising:

a tank configured to hold a liquid to be vaporized;

an atomizer coupled to the tank and configured to vaporize the liquid;

a power supply operatively connected to the atomizer; and a mouthpiece assembly having an interior space and a mouthpiece aperture through which vapor is delivered to a user;

wherein the mouthpiece assembly comprises a movable component mounted within the interior space and configured to undergo movement between a first position in which the mouthpiece aperture is open to permit passage of vapor to the user, and a second position in which the mouthpiece aperture is closed to prevent passage of vapor; and wherein the movable component is configured to undergo movement along a longitudinal axis of the vaporizer apparatus to transition between the first position and the second position.

19. A vaporizer apparatus comprising:

a tank configured to hold a liquid to be vaporized;

an atomizer coupled to the tank and configured to vaporize the liquid;

a power supply operatively connected to the atomizer; and a mouthpiece assembly defining a vapor intake aperture and a mouthpiece aperture through which vapor is delivered from the intake aperture to a user, the mouthpiece assembly comprising:

a case defining a central axis that is shared with a central axis of the vaporizer apparatus; and a movable component configured to undergo axial movement relative to the case in a direction parallel to the central axis of the case between:

(i) a first position in which the mouthpiece aperture is open to permit delivery of vapor to the user; and (ii) a second position in which the movable component, only by movement parallel to the central axis of the case to the second position, closes the mouthpiece aperture to prevent delivery of vapor to the user.

20. The vaporizer apparatus of claim 19, wherein the case is configured to guide axial movement of the movable component between the first and second positions.

21. The vaporizer apparatus of claim 19, wherein the movable component has a portion configured to undergo axial movement over an exterior surface portion of the case.

* * * * *